US011590547B2

(12) United States Patent
Mizumura et al.

(10) Patent No.: US 11,590,547 B2
(45) Date of Patent: Feb. 28, 2023

(54) METHOD OF MANUFACTURING VARIABLE WALL THICKNESS STEEL PIPE AND VARIABLE WALL THICKNESS STEEL PIPE

(71) Applicant: NIPPON STEEL & SUMITOMO METAL CORPORATION, Tokyo (JP)

(72) Inventors: Masaaki Mizumura, Tokyo (JP); Keinosuke Iguchi, Tokyo (JP); Hidehiro Arita, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 518 days.

(21) Appl. No.: 16/082,894

(22) PCT Filed: Feb. 14, 2017

(86) PCT No.: PCT/JP2017/005278
§ 371 (c)(1),
(2) Date: Sep. 6, 2018

(87) PCT Pub. No.: WO2017/154481
PCT Pub. Date: Sep. 14, 2017

(65) Prior Publication Data

US 2019/0076902 A1 Mar. 14, 2019

(30) Foreign Application Priority Data

Mar. 11, 2016 (JP) ..... JP2016-048657
Dec. 19, 2016 (JP) ..... JP2016-245864

(51) Int. Cl.
*B21C 37/16* (2006.01)
*B21D 39/20* (2006.01)
(Continued)

(52) U.S. Cl.
CPC ..... *B21C 37/16* (2013.01); *B21C 1/24* (2013.01); *B21C 37/065* (2013.01); *B21D 39/20* (2013.01); *B21J 5/08* (2013.01); *B21K 21/12* (2013.01)

(58) Field of Classification Search
CPC .. B21D 39/20; B21C 1/24; B21C 1/26; B21C 3/16; B21C 37/16; B21C 37/065; B21K 21/12; B21J 5/08
(Continued)

(56) References Cited

U.S. PATENT DOCUMENTS 1,511,091 A * 10/1924 O'Rourke ..... B21C 3/16 72/467
3,950,978 A * 4/1976 Wassen ..... B21C 1/24 72/283
(Continued)

FOREIGN PATENT DOCUMENTS

CN 1528542 A 9/2004
CN 1886210 A 12/2006
(Continued)

OTHER PUBLICATIONS

Technical Tidbits, "Strain Hardening & Strength", May 2010, Brush Wellman Inc., Issue 17 (Year: 2010).*
(Continued)

*Primary Examiner* — Teresa M Ekiert
(74) *Attorney, Agent, or Firm* — Birch, Stewart, Kolasch & Birch, LLP

(57) ABSTRACT

There is provided a method of manufacturing a variable wall thickness steel pipe with a hollow tubular raw pipe. The method of manufacturing a variable wall thickness steel pipe includes locking the raw pipe in a die by thrusting a plug into the raw pipe from an one end side, so as to expand an outer shape on the one end side in a state, where the raw pipe is
(Continued)

disposed inside the die and movement of the raw pipe in a longitudinal direction is restricted; and performing ironing in which an inner shape of the raw pipe is expanded while the outer shape is maintained so that a thin portion is formed by further thrusting the plug toward the other end side of the raw pipe while the locked state of the raw pipe is maintained, whereas the restriction on the raw pipe is relaxed.

12 Claims, 13 Drawing Sheets

(51) Int. Cl.

| | |
|---|---|
| ***B21J 5/08*** | (2006.01) |
| ***B21C 1/24*** | (2006.01) |
| ***B21C 37/06*** | (2006.01) |
| ***B21K 21/12*** | (2006.01) |

(58) Field of Classification Search
USPC ..... 72/276, 283, 370.01, 370.06, 370.1, 72/370.14, 370.23, 370.24
See application file for complete search history.

(56) References Cited

U.S. PATENT DOCUMENTS

| | | | | | |
|---|---|---|---|---|---|
| 4,301,672 | A * | 11/1981 | Simon | B21C 25/08 | 72/260 |
| 4,454,745 | A | 6/1984 | Cudini | | |
| 4,534,199 | A * | 8/1985 | Takaishi | B21C 37/16 | 138/121 |
| 4,616,500 | A * | 10/1986 | Alexoff | B21C 37/16 | 72/276 |
| 4,726,211 | A * | 2/1988 | Sunaga | B21C 37/16 | 72/276 |
| 5,522,246 | A | 6/1996 | Simon | | |
| 5,533,376 | A * | 7/1996 | Wetzels | B21C 1/24 | 72/283 |
| 6,837,091 | B2 * | 1/2005 | Brochheuser | B21C 1/18 | 72/283 |
| 8,074,482 | B2 * | 12/2011 | Okui | B21C 1/24 | 72/283 |
| 8,210,017 | B2 * | 7/2012 | Suzuki | B21C 51/00 | 72/276 |
| 2007/0256467 | A1 | 11/2007 | Viegner, Jr. et al. | | |
| 2008/0115553 | A1 | 5/2008 | Brochheuser et al. | | |
| 2009/0152065 | A1 * | 6/2009 | Shimai | B21D 39/20 | 188/379 |
| 2010/0139356 | A1 | 6/2010 | Brochheuser et al. | | |

FOREIGN PATENT DOCUMENTS

| | | | | | |
|---|---|---|---|---|---|
| CN | 101754820 | A | | 6/2010 | |
| CN | 102632093 | A | | 8/2012 | |
| EP | 0811444 | A1 | | 12/1997 | |
| JP | 59047018 | A | * | 3/1984 | B21C 37/30 |
| JP | 59-73115 | A | | 4/1984 | |
| JP | 61123415 | A | * | 6/1986 | |
| JP | 7-148516 | A | | 6/1995 | |
| JP | 9-327723 | A | | 12/1997 | |
| JP | 2001-121210 | A | | 5/2001 | |
| JP | 2006-110567 | A | | 4/2006 | |
| JP | 2006110567 | A | * | 4/2006 | |
| JP | 2008-520440 | A | | 6/2008 | |
| JP | 2010-179319 | A | | 8/2010 | |
| JP | 2012-16712 | A | | 1/2012 | |

OTHER PUBLICATIONS

Chinese Office Action and Search Report for counterpart Chinese Application No. 201780016090.5, dated Jul. 2, 2019, with English translation of the Search Report only.
International Search Report for PCT/JP2017/005278 (PCT/ISA/210) dated May 23, 2017.
Written Opinion of the International Searching Authority for PCT/JP2017/005278 (PCT/ISA/237) dated May 23, 2017.
Extended European Search Report, dated Jan. 21, 2020, for corresponding European Application No. 17762824.5.

* cited by examiner

METHOD OF MANUFACTURING VARIABLE WALL THICKNESS STEEL PIPE AND VARIABLE WALL THICKNESS STEEL PIPE

TECHNICAL FIELD OF THE INVENTION

The present invention relates to a method of manufacturing a variable wall thickness steel pipe and a variable wall thickness steel pipe.

Priority is claimed on Japanese Patent Application No. 2016-048657, filed on Mar. 11, 2016 and Japanese Patent Application No. 2016-245864, filed on Dec. 19, 2016, the contents of which are incorporated herein by reference.

RELATED ART

It is desired that a vehicle body member constituting a vehicle body of an automobile has a part which absorbs collision energy by being crushed by impact load when an impact such as a collision is received, and a part which protects the vehicle body without being crushed. In order to provide such a vehicle body member, utilization of a variable wall thickness steel pipe having a thickness varying in a longitudinal direction has been studied.

For example, as a method of manufacturing a drawn steel pipe having a plurality of diameters, FIG. 7 of Patent Document 1 discloses a method of manufacturing a stepped drawn pipe having predetermined inner diameters and outer diameters in a plurality of locations. In the method, a die and a tap are fixed to be movable in a drawing direction and a steel pipe is drawn while being pressure-clamped by bearing surfaces facing each other.

In addition, FIG. 7 of Patent Document 2 discloses a method of manufacturing a variable wall thickness steel pipe using a die and a plug each having two steps of diameters. The method includes a step of forming a base steel pipe restricted in size by a bearing diameter d2 (small diameter) of the die and a bearing diameter d3 (small diameter) of the plug, a step of forming a base steel pipe restricted in size by the bearing diameter d2 (small diameter) of the die and a bearing diameter d4 (large diameter) of the plug, and a step of forming a base steel pipe restricted in size by a bearing diameter d1 (large diameter) of the die and the bearing diameter d4 (large diameter) of the plug.

PRIOR ART DOCUMENT

Patent Document

[Patent Document 1] Japanese Unexamined Patent Application, First Publication No. S59-73115

[Patent Document 2] Japanese Unexamined Patent Application, First Publication No. 2012-16712

DISCLOSURE OF THE INVENTION

Problems to be Solved by the Invention

Incidentally, some vehicle body members or vehicle body components constituting a vehicle body of an automobile are obtained by performing bending with respect to a member having a hollow closed cross-sectional shape and partially forming a bent part. In variable wall thickness steel pipes obtained by manufacturing methods in Patent Document 1 or Patent Document 2, working is performed with respect to an entire raw pipe in a longitudinal direction. Accordingly, the entirety is in a work-hardened state. In order to perform bending or the like with respect to such a variable wall thickness steel pipe which has been entirely work-hardened, there is a need to soften the work-hardening of variable wall thickness steel pipe by performing heat treatment in advance. If such heat treatment becomes unnecessary, considerable labor-saving can be expected when a variable wall thickness steel pipe is worked into a vehicle body member. In addition, since heat treatment is omitted, degeneration in the steel structure of the variable wall thickness steel pipe can also be prevented.

The present invention has been made in consideration of the foregoing circumstances and an object thereof is to provide a variable wall thickness steel pipe and a method of manufacturing a variable wall thickness steel pipe, in which a working amount at the time of manufacturing is small and heat treatment such as annealing becomes unnecessary when post-working such as bending is performed.

Means For Solving the Problem

In order to achieve the object, the present invention employs each of the following aspects.

(1) According to an aspect of the present invention, there is provided a method of manufacturing a variable wall thickness steel pipe with a hollow tubular raw pipe. The method includes locking the raw pipe in a die by thrusting a plug into the raw pipe from an one end side so as to expand an outer shape on the one end side, in a state where the raw pipe is disposed inside the die and movement of the raw pipe in a longitudinal direction is restricted; and performing ironing in which an inner shape of the raw pipe is expanded while the outer shape is maintained so that a thin portion is formed by further thrusting the plug toward the other end side of the raw pipe while the locked state of the raw pipe is maintained, whereas the restriction on the raw pipe is relaxed.

(2) In the method of manufacturing a variable wall thickness steel pipe according to (1), in the performing ironing, an unprocessed portion may remain on the other end side of the raw pipe by stopping thrusting the plug in the middle.

(3) In the method of manufacturing a variable wall thickness steel pipe according to (1) or (2), a thickness reduction rate of the thin portion in the performing ironing may be within a range from 10% to 90%.

(4) In the method of manufacturing a variable wall thickness steel pipe according to any one of (1) to (3), the plug used in the locking and the performing ironing may include a tip end portion having an outer shape size smaller than an inner shape size of the raw pipe, a base end portion having an outer shape size larger than the inner shape size of the raw pipe and smaller than an outer shape size of the raw pipe, and a tapered portion being provided between the tip end portion and the base end portion to be tapered from the base end portion toward the tip end portion.

(5) In the method of manufacturing a variable wall thickness steel pipe according to any one of (1) to (3), the plug used in the locking and the performing ironing may include a base end portion having an outer shape size larger than an inner shape size of the raw pipe and smaller than an outer shape size of the raw pipe, and a tip end portion leading to a tip end side of the base end portion and being tapered as being separated from the base end portion.

(6) In the method of manufacturing a variable wall thickness steel pipe according to (4) or (5), the base end portion may have a large-sized base end portion being disposed on the tip end portion side, and a small-sized base end portion having an outer shape size smaller than an outer shape size of the large-sized base end portion.

(7) According to another aspect of the present invention, there is provided a method of manufacturing a variable wall thickness steel pipe with a hollow tubular raw pipe. The method includes locking the raw pipe in a die by thrusting a first plug into the raw pipe from one end side, so as to expand an outer shape size on the one end side, in a state where the raw pipe is disposed inside the die and movement of the raw pipe in a longitudinal direction is restricted; pulling the first plug from the raw pipe; and performing ironing in which an inner shape of the raw pipe is expanded while an outer shape of the raw pipe is maintained so that a thin portion is formed by thrusting a second plug, which has an outer shape different from the outer shape of the first plug, from the one end side of the raw pipe toward the other end side while the locked state of the raw pipe is maintained, whereas the restriction on the raw pipe is relaxed.

(8) In the method of manufacturing a variable wall thickness steel pipe according to (7), the second plug used in the performing ironing may include a small-sized tip end portion smaller than an inner shape size of the raw pipe, an intermediate-sized portion having an outer shape size larger than the inner shape size of the raw pipe, a large-sized portion having an outer shape size larger than the outer shape size of the intermediate-sized portion and smaller than an outer shape size of the raw pipe, a first tapered portion being provided between the small-sized tip end portion and the intermediate-sized portion, and a second tapered portion being provided between the intermediate-sized portion and the large-sized portion.

(9) In the method of manufacturing a variable wall thickness steel pipe according to (7), the second plug used in the performing ironing may include a base end portion having an outer shape size larger than the inner shape size of the raw pipe and smaller than an outer shape size of the raw pipe, and a third tapered portion being tapered from the base end portion toward a tip end portion.

(10) In the method of manufacturing a variable wall thickness steel pipe according to any one of (1) to (9), the die may include a hollow small-sized portion having an inner shape size corresponding to the outer shape size of the raw pipe, a hollow large-sized portion having an inner shape size larger than the outer shape size of the raw pipe, and a hollow tapered portion being provided between the hollow small-sized portion and the hollow large-sized portion and being tapered from the hollow large-sized portion toward the hollow small-sized portion.

(11) In the method of manufacturing a variable wall thickness steel pipe according to (10), the die may further include a hollow intermediate-diameter portion being provided in a part of the hollow small-sized portion in the longitudinal direction and having an inner shape size larger than the outer shape size of the raw pipe.

(12) The method of manufacturing a variable wall thickness steel pipe according to any one of (1) to (11) may further include drawing the raw pipe after performing ironing.

(13) According to another aspect of the present invention, there is provided a method of manufacturing a variable wall thickness steel pipe with a hollow tubular raw pipe. The method includes locking the raw pipe in a die by simultaneously or alternately thrusting plugs into the raw pipe respectively from one end side and the other end side of the raw pipe, so as to expand an outer shape on the one end side and an outer shape on the other end side; pulling the plug on the other end side while the plug is inserted on the one end side; performing first ironing in which an inner shape of the raw pipe is expanded while the outer shape is maintained so that a first thin portion is formed by further thrusting the plug, which is inserted on the one end side, toward the other end side of the raw pipe while the one end side is locked in the die; inserting and pulling the plugs such that the plug is inserted on the other end side, whereas the plug on the one end side is pulled out; and performing second ironing in which the inner shape of the raw pipe is expanded while the outer shape is maintained so that a second thin portion is formed by further thrusting the plug on the other end side toward the one end side of the raw pipe while the other end side is locked in the die. In the locking, the raw pipe freely moves in a longitudinal direction of the raw pipe in a case where the plugs are simultaneously thrust, and movement of the raw pipe in a thrusting direction of the plugs is restricted in a case where the plugs are alternately thrust.

(14) The method of manufacturing a variable wall thickness steel pipe according to (13) may further include drawing the raw pipe after performing second ironing.

(15) In the method of manufacturing a variable wall thickness steel pipe according to any one of (1) to (14), the raw pipe may be a seamless steel pipe.

(16) According to an aspect of the present invention, there is provided a variable wall thickness steel pipe which employs the following configuration including an expanded portion that is provided on one side in a longitudinal direction and has a largest outer shape size in a case of being seen in a cross section perpendicular to the longitudinal direction, and a thin portion that is provided on the other side of the expanded portion in a case of being seen in the longitudinal direction and has a thickness smaller than a thickness of the expanded portion. In a case where an average value of hardness of the expanded portion is H1 and an average value of hardness of the thin portion is H2, $H2>H1$ may be satisfied.

As a way of obtaining each of the average values of hardness according to the specification of this application, the average value is obtained by measuring hardness of five spots on a part of a manufactured variable wall thickness steel pipe at a central position in a thickness direction at intervals of 1 mm in the longitudinal direction of the same variable wall thickness steel pipe, and calculating the average value of hardness of the five spots. In a case where if it is difficult to obtain five measurement spots due to the small size, hardness of five spots may be measured at intervals of 1 mm in the circumferential direction of the variable wall thickness steel pipe, and the average value of the five spots may be calculated and used.

(17) The variable wall thickness steel pipe according to (16) may employ the following configuration further including a thick portion that is disposed on the other side of the thin portion in a case of being seen in the longitudinal direction and has a thickness greater than the thickness of the thin portion. In a case where an average value of hardness of the thick portion is H3, $H2>H1\geq H3$ may be satisfied.

(18) The variable wall thickness steel pipe according to (17) may employ the following configuration. The thin portion includes a straight pipe portion having a smallest thickness in the thin portion, a first tapered portion being provided between the straight pipe portion and the expanded portion and having an outer shape expanded toward the expanded portion, and a second tapered portion being provided between the straight pipe portion and the thick portion and having a thickness increasing toward the thick portion. In a case where an average value of hardness of the first tapered portion is H4, an average value of hardness of the straight pipe portion is H5, and an average value of hardness of the second tapered portion is H6, both expressions H5>H6≥H3 and H5>H4>H1 may be satisfied.

(19) In the variable wall thickness steel pipe according to any one of (16) to (18), the thickness of the thin portion may be partially increased in a case of being seen in the longitudinal direction.

(20) In the variable wall thickness steel pipe according to (16), combinations of the expanded portions and the thin portions may be symmetrically provided at both ends in the longitudinal direction.

(21) The variable wall thickness steel pipe according to (20) may employ the following configuration further including a thick portion that is disposed between a pair of the thin portions and has a thickness greater than the thickness of the thin portion. In a case where an average value of hardness of the thick portion is H7, H2>H1≥H7 may be satisfied.

(22) According to another aspect of the present invention, there is provided a variable wall thickness steel pipe which employs the following configuration including a thick portion that is provided on one side in a longitudinal direction and has a greatest thickness in a case of being seen in a cross section perpendicular to the longitudinal direction, and a thin portion that is provided on the other side of the thick portion and has a thickness smaller than the thickness of the thick portion. An outer shape size in the longitudinal direction is constant. In a case where an average value of hardness of the thick portion is H8 and an average value of hardness of the thin portion is H9, H9>H8 is satisfied.

(23) In the variable wall thickness steel pipe according to any one of (16) to (22), in a case where the thin portion is seen in a circumferential direction of the thin portion in a cross section perpendicular to the longitudinal direction, the thin portion may have a rotationally symmetric shape in which regions having a relatively small thickness and relatively high hardness and regions having a relatively great thickness and relatively low hardness alternate with each other in the circumferential direction.

(24) In the variable wall thickness steel pipe according to any one of (16) to (23), a seamless steel pipe may be used as a material.

As the various types of hardness above, for example, Vickers hardness may be used.

Effects of the Invention

According to the present invention, for example, in the method of manufacturing a variable wall thickness steel pipe according to (1), it is possible to perform ironing in which the inner shape is expanded while the outer shape of the raw pipe is maintained by thrusting the plug into the raw pipe from one end side while the outer shape of the raw pipe on one end side is expanded and the raw pipe is locked in the die. Thus, the working amount to be applied to one end side of the raw pipe can be reduced to a working amount as small as the outer shape size thereof is expanded. Therefore, since work-hardening is small on one end side of the raw pipe, heat treatment such as annealing can be made unnecessary when post-working such as bending is performed.

In addition, since ironing is performed by thrusting the plug into the raw pipe while one end side of the raw pipe is locked in the die, there is no need to fix the raw pipe itself to the die, and ironing can be carried out by only relatively moving the plug with respect to the die.

Therefore, in the method of manufacturing a variable wall thickness steel pipe according to the aspect of the present invention, it is possible to easily manufacture a variable wall thickness steel pipe in which a part having a great thickness on one end side and a thin portion subjected to ironing are formed.

Particularly, in the method of manufacturing a variable wall thickness steel pipe according to (2), since an unprocessed portion having a zero working amount can remain on the other end side of the raw pipe, heat treatment such as annealing can be made unnecessary when post-working such as bending is performed with respect to the unprocessed portion.

In addition, in the method of manufacturing a variable wall thickness steel pipe according to (7), for example, two regions, of which the inner shape sizes are different from each other, can be provided inside the thin portion, and it is possible to manufacture a variable wall thickness steel pipe in which the thickness and strength vary in stages in the longitudinal direction.

EMBODIMENTS OF THE INVENTION

A variable wall thickness steel pipe and a method of manufacturing a variable wall thickness steel pipe according to each of embodiments of the present invention will be described below with reference to the drawings. In each of the embodiments, a raw pipe 1 having tensile strength of 290 MPa or higher is preferably used as a material.

First Embodiment

A method of manufacturing a variable wall thickness steel pipe according to the first embodiment includes a step of forming a diameter-increasing portion by performing pipe expanding with respect to a part on one end side of a raw pipe using a die and a plug, and a step of ironing a middle portion on the other end side of the diameter-increasing portion such that the inner diameter of the raw pipe is increased while the outer diameter is maintained. Examples of a raw pipe as a working target in the present embodiment can include a hollow tubular metal pipe. Particularly, a round steel pipe is preferably used. As the round steel pipe, any of a seamless steel pipe, a UO pipe, a spiral pipe, and an electric resistance welded steel pipe can be applied.

Next, the die and the plug used in the manufacturing method of the present embodiment will be described with reference to FIGS. 1(*a*) to 1(*c*). A die 11 according to the present embodiment includes a die main body 11*d*. Inside the die main body 11*d*, a hollow small-diameter portion 11*a* having an inner diameter corresponding to an outer diameter $d_1$ of the raw pipe 1, a hollow large-diameter portion 11*b* having an inner diameter larger than the outer diameter $d_1$ of the raw pipe 1, and a tapered portion 11*c* being provided between the hollow small-diameter portion 11*a* and the hollow large-diameter portion 11*b* are formed. The hollow small-diameter portion 11*a*, the hollow large-diameter portion 11*b*, and the tapered portion 11*c* communicate with each other inside the die main body 11*d*. The "inner diameter corresponding to the outer diameter $d_1$ of the raw pipe 1" indicates an inner diameter size in which a gap size to the extent that the raw pipe 1 can be taken out and put in with respect to the inside and the outside of the hollow small-diameter portion 11*a* is added to the outer diameter $d_1$ of the raw pipe 1.

Figure 1:
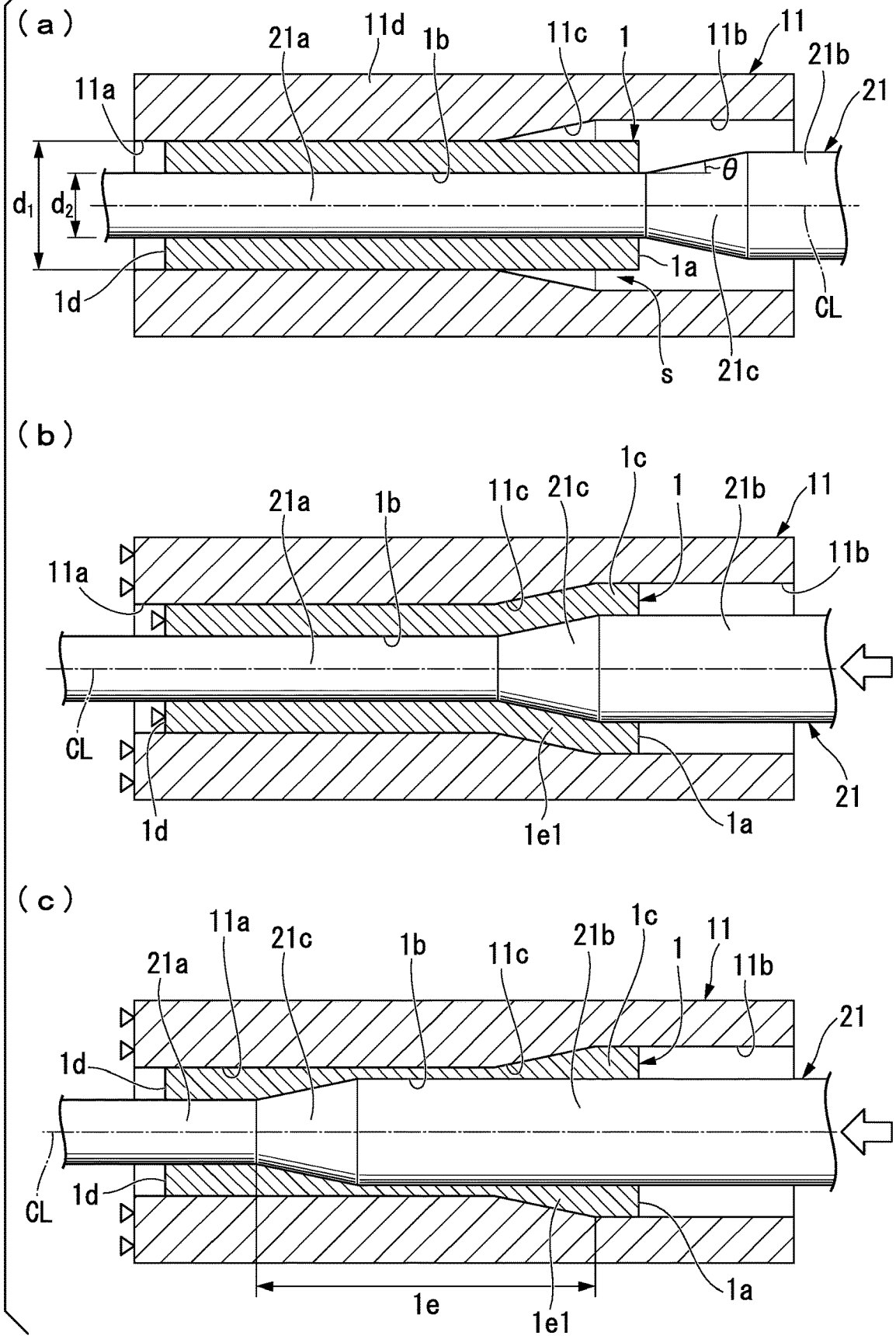
FIG. 1 is a process drawing showing a method of manufacturing a variable wall thickness steel pipe according to a first embodiment of the present invention and is a cross-sectional view seen in a cross section including an axis of a raw pipe.

A tapered portion 21*c* of a plug 21 in FIGS. 1(*a*) to 1(*c*) has an outer circumferential surface forming a taper angle θ based on a line parallel to an axis CL in a case of being seen in a cross section including the axis CL of the plug 21. It is preferable that the taper angle θ is within a range from 1 to 40 degrees. If the taper angle θ is smaller than 1 degree, snapping of the plug 21 in its entirety with respect to the raw pipe 1 becomes significant, so that a required working force becomes excessive. Meanwhile, if the taper angle θ exceeds 40 degrees, a local surface pressure generated in the tapered portion 21*c* of the plug 21 at the time of thinning becomes excessive, so that there is a possibility that deterioration of a life span of the plug 21 will be caused.

The plug 21 according to the present embodiment is configured to include a small-diameter tip end portion 21*a* corresponding to an inner diameter $d_2$ of the raw pipe 1, a large-diameter base end portion 21*b* having a diameter larger than the inner diameter $d_2$ of the raw pipe 1 and a diameter smaller than the inner diameter of the hollow small-diameter portion 11*a* of the die 11, and the tapered portion 21*c* being provided between the small-diameter tip end portion 21*a* and the large-diameter base end portion 21*b*. The outer diameter of the large-diameter base end portion 21*b* is set to have a size smaller than the inner diameter $d_1$ of the hollow small-diameter portion 11*a* of the die 11.

In order to manufacture a variable wall thickness steel pipe according to the present embodiment, first, as shown in FIG. 1(*a*), the raw pipe 1 is coaxially inserted into the die 11. At this time, positional alignment is performed such that one end portion 1*a* of the raw pipe 1 is positioned inside the hollow large-diameter portion 11*b* of the die 11. Then, each of the die 11 and the raw pipe 1 are in a fixed state. That is, the die 11 is in a state fixed to a base (not shown). In addition, the raw pipe 1 is stemmed such that an end portion of the raw pipe 1 on the sheet left side does not further move forward to the sheet left side. Accordingly, the relative position of the raw pipe 1 with respect to the die 11 in a longitudinal direction is fixed.

After the raw pipe 1 is fixed inside the die 11, the small-diameter tip end portion 21*a* of the plug 21 is inserted from the one end portion 1*a* side of the raw pipe 1 toward a hollow portion 1*b* of the raw pipe 1.

Next, as shown in FIG. 1(*b*), as a diameter-increasing step, while the die 11 and the raw pipe 1 are in a fixed state, the tapered portion 21*c* and the large-diameter base end portion 21*b* of the plug 21 are thrust into the one end portion 1*a* of the raw pipe 1. The plug 21 is thrust until the tapered portion 21*c* reaches the position of the tapered portion 11*c* of the die 11. In this manner, until the tapered portion 21*c* reaches the position of the tapered portion 11*c* of the die 11, the relative position of the raw pipe 1 with respect to the die 11 is continuously fixed. Therefore, the raw pipe 1 is not pushed out from the die 11 by the tapered portion 21*c*.

For example, it is possible to manage whether or not the tapered portion 21*c* has reached the position of the tapered portion 11*c* by measuring the amount of a thrusting stroke of the plug 21 or reaction increasing in response to a thrust of the plug 21.

At the point of time of FIG. 1(*a*), when the raw pipe 1 is disposed inside the die 11, the one end portion 1*a* of the raw pipe 1 is positioned inside the hollow large-diameter portion 11*b* of the die 11. Therefore, there is a gap s between the hollow large-diameter portion 11*b* of the die 11 and the one end portion 1*a* of the raw pipe 1. If the plug 21 is thrust from this state as illustrated in FIG. 1(*b*), the one end portion 1*a* of the raw pipe 1 is increased in diameter by the tapered portion 21*c* and the large-diameter base end portion 21*b* of the plug 21. Accordingly, the gap s is gradually reduced, and the outer circumferential surface of the one end portion 1*a* eventually abuts on the inner circumferential surface of the tapered portion 11*c* of the die 11 and the inner circumferential surface of the hollow large-diameter portion 11*b*. In this manner, a straight pipe-shaped diameter-increasing portion 1*c* and a lock portion 1*e*1 leading to the diameter-increasing portion 1*c* are formed in the one end portion 1*a* of the raw pipe 1. The lock portion 1*e*1 forms a part of a middle portion 1*e* and has a tapered truncated conical shape having a tapered surface in tight contact with the tapered portion 11*c* of the die 11 as the outer circumferential surface.

When the diameter-increasing portion 1*c* is formed, a slight pulling strain is applied to the one end portion 1*a* of the raw pipe 1 in the circumferential direction.

Next, as shown in FIG. 1(*c*), as an ironing step, in a state where the fixed state of the raw pipe 1 is released, whereas the fixed state of the die 11 is maintained, the plug 21 is further thrust toward the other end portion 1*d* side of the raw pipe 1. That is, as shown in FIG. 1(*b*), after the diameter-increasing portion 1*c* is formed, the stemmed state of the raw pipe 1 toward the end portion on the sheet left side is released. Thereafter, thrusting of the plug 21 further proceeds. As the plug 21 is further thrust, the raw pipe 1 is pushed from the one end portion 1*a* toward the other end portion 1*d* side. However, since the lock portion 1*e*1 formed in the raw pipe 1 in the previous step remains locked in the tapered portion 11*c* of the die 11, the raw pipe 1 does not move.

As the plug 21 is further thrust, the large-diameter base end portion 21*b* of the plug 21 is thrust toward the other end portion 1*d* side of the raw pipe 1. In the middle portion 1*e* of the raw pipe 1 in which the large-diameter base end portion 21*b* of the plug 21 is thrust, the original inner diameter $d_2$ of the raw pipe 1 is increased to a size corresponding to the diameter of the large-diameter base end portion 21*b* of the plug 21. On the other hand, since the middle portion 1*e* of the raw pipe 1 is positioned inside the hollow small-diameter portion 11*a* of the die 11 and its outer diameter size is restricted due to the surroundings, the outer diameter $d_1$ of the middle portion 1*e* is not increased. Therefore, the middle portion 1*e* of the raw pipe 1 is subjected to ironing while the original outer diameter $d_1$ of the raw pipe 1 is maintained.

The reason for releasing the stemmed state of the raw pipe 1 immediately before ironing starts is that a flow of the thickness of the raw pipe 1 entailed in ironing is not to be hindered. That is, when the middle portion 1*e* of the raw pipe 1 is reduced in thickness through ironing, in order to ensure as much room for the quantity as thickness reduction, the stemmed state of the raw pipe 1 is released. Accordingly, a part of the raw pipe 1 on the sheet left side is prevented from being buckled. In the present embodiment, since the quantity of thickness reduction of the raw pipe 1 due to ironing flows toward the sheet left side, the entire length of the raw pipe 1 becomes slightly longer than that before working.

In order to achieve an effect of improving strength of the middle portion 1*e* due to ironing, the thickness reduction rate of the raw pipe 1 due to ironing is required to be 10% or higher. Meanwhile, if the thickness reduction rate of the raw pipe 1 due to ironing exceeds 90%, there is concern that a fracture, burning, or the like is caused. Therefore, it is favorable that the thickness reduction rate of the raw pipe 1 due to ironing is within a range from 10% to 90%. Preferably, it is favorable that the thickness reduction rate is within a range from 20% to 80%. When the thickness of the raw pipe 1 before ironing is $d_0$ and the thickness of the middle portion 1*e* after ironing is d, the thickness reduction rate (%) is expressed by $(d_0-d)/d_0\times100(\%)$.

Here, in a case where the thickness d of the middle portion 1*e* after ironing is not uniform when seen in the longitudinal direction of the raw pipe 1, and there is a distribution, the numerical value obtained in a location having the greatest amount of thickness reduction is employed as the thickness reduction rate. That is, in the middle portion 1*e*, the value obtained in a location in which the difference (equivalent strain amount) obtained by subtracting d from $d_0$ is the greatest in a case of being seen in its longitudinal direction is employed as the thickness reduction rate described above. Furthermore, in a case where the amount of thickness reduction is not uniform in the circumferential direction of the raw pipe 1 and there is a distribution, the value obtained in a location in which the amount of thickness reduction is the greatest in the distribution in the circumferential direction is employed as the thickness reduction rate described above.

The thickness reduction rate can be adjusted by changing the diameter of the large-diameter base end portion 21*b* of the plug 21. The above-described appropriate range related to the thickness reduction rate in ironing is the same in other embodiments to be described below.

In the example shown in FIG. 1(*c*), the tapered portion 21*c* and the large-diameter base end portion 21*b* of the plug 21 are thrust to a position in front of the other end portion 1*d* of the raw pipe 1. If thrusting of the plug 21 stops at the position as illustrated in FIG. 1(*c*), a part on the other end portion 1*d* side of the middle portion 1*e* of the raw pipe 1 remains unprocessed. In this specification, a part that "remains unprocessed" denotes a part having substantially the same strength (tensile strength) or hardness of the raw pipe 1 before working (base metal) in a variable wall thickness steel pipe.

Figure 2:
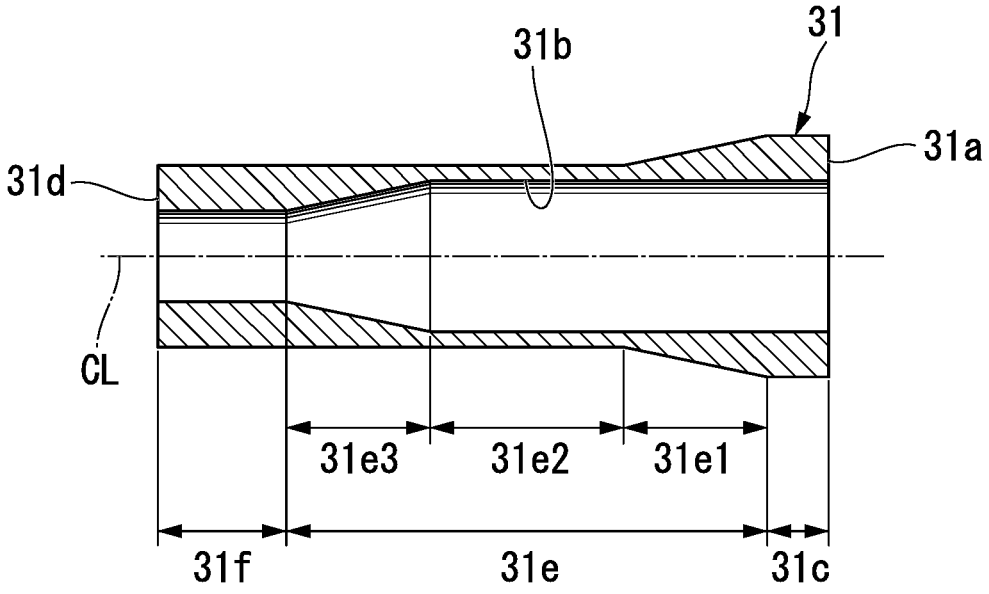
FIG. 2 is a view showing an example of a variable wall thickness steel pipe manufactured by the method of manufacturing a variable wall thickness steel pipe of the same embodiment and is a cross-sectional view seen in a cross section including the axis.

FIG. 2 shows a schematic cross-sectional view of a variable wall thickness steel pipe 31 manufactured via the steps shown in FIGS. 1(*a*) to 1(*c*). In the description below, in order to distinguish the manufactured variable wall thickness steel pipe from the raw pipe 1 before working and during working in the description, the new reference sign 31 is allocated thereto. Similarly, the description will proceed while having new reference signs applied to portions constituting the variable wall thickness steel pipe 31. In order to clarify the correspondence relationship with respect to the portions constituting the raw pipe 1, there are cases where parenthesized reference signs are appended to portions at the point of time of the raw pipe 1. The same also applies to each of the embodiments to be described below.

The variable wall thickness steel pipe 31 shown in FIG. 2 is configured to include a diameter-increasing portion 31*c* (1*c*) which is located on one end portion 31*a* (1*a*) side and is increased in diameter from the raw pipe 1, a middle portion 31*e* (1*e*) which is located between the one end portion 31*a* and the other end portion 31*d* (1*d*) and is subjected to ironing, and an unprocessed portion 31*f* which is located on the other end portion 31*d* side of the middle portion 31*e* and remains unprocessed as the raw pipe 1. The middle portion 31*e* also includes a part subjected to working by the tapered portions 11*c* and 21*c* of the die 11 and the plug 21 at each of boundaries with respect to the diameter-increasing portion 31*c* and the unprocessed portion 31*f*. That is, in a case of being seen from the one end portion 31*a* toward the other end portion 31*d*, the middle portion 31*e* includes a lock portion 31*e*1 (1*e*1) having a constant inner diameter and a tapered outer diameter, a straight pipe portion 31*e*2 having an inner diameter and an outer diameter both of which are constant, and a tapered portion 31*e*3 having a constant outer diameter and a tapered inner diameter. Then, in a case where the average value of hardness of the diameter-increasing portion 31*c* is H1, the average value of hardness of the unprocessed portion 31*f* is H3, the average value of hardness of the lock portion 31*e*1 is H4, the average value of hardness of the straight pipe portion 31*e*2 is H5, and the average value of hardness of the tapered portion 31*e*3 is H6, both expressions H5>H6≥H3 and H5>H4>H1 are satisfied.

In FIG. 2, for the description, the diameter-increasing portion 31*c* is shown to have a short ring shape. However, as necessary, the diameter-increasing portion 31*c* may have a long straight pipe shape. The same applies to each of a diameter-increasing portion 41*c*, a diameter-increasing portion 61*c*, a diameter-increasing portion 91*c*, diameter-increasing portions 111*c* and 111*f*, a diameter-increasing portion 121*c*, a diameter-increasing portion 141*c*, and a diameter-increasing portion 151*c* in other embodiments to be described below.

In the diameter-increasing portion 31*c* and the middle portion 31*e*, a hollow portion 31*b* of the variable wall thickness steel pipe 31 is further increased in diameter than the original inner diameter $d_2$ of the raw pipe 1. In the unprocessed portion 31*f*, the original inner diameter $d_2$ of the raw pipe 1 remains unchanged. In addition, the outer diameter of the variable wall thickness steel pipe 31 is gradually increased from the outer diameter $d_1$ of the raw pipe 1 in the lock portion 31*e*1. Then, in the diameter-increasing portion 31*c*, the outer diameter thereof is constant while being further increased than the outer diameter $d_1$ of the raw pipe 1. Meanwhile, a part excluding the lock portion 31*e*1 in the middle portion 31*e*, and the unprocessed portion 31*f* remain having an outer diameter equal to the outer diameter $d_1$ of the raw pipe 1. Accordingly, the variable wall thickness steel pipe 31 has a comparatively great thickness in the diameter-increasing portion 31*c* and the unprocessed portion 31*f* and has a comparatively small thickness in the middle portion 31*e*.

In the variable wall thickness steel pipe 31 shown in FIG. 2, since a small working amount is applied to the diameter-increasing portion 31*c* and the unprocessed portion 31*f*, no work hardening has occurred in these parts, or even if work hardening has occurred, it is very insignificant. Therefore, the diameter-increasing portion 31*c* and the unprocessed portion 31*f* have comparatively low strength. Accordingly, even in a case where post-working such as bending is performed with respect to these parts, annealing treatment or the like for softening work hardening becomes unnecessary.

In addition, since a large working amount is applied to the middle portion 31*e* of the variable wall thickness steel pipe 31, the middle portion 31*e* has comparatively high strength due to work hardening. That is, as seen in a hardness distribution (Vickers hardness distribution, determination can also be made through a tensile strength distribution instead of Vickers hardness distribution) in the longitudinal direction of the variable wall thickness steel pipe 31, the unprocessed portion 31*f* has the lowest hardness, and the diameter-increasing portion 31*c* has hardness slightly higher than hardness of the unprocessed portion 31*f*. Then, the middle portion 31*e* has hardness higher than hardness of the diameter-increasing portion 31*c*. Therefore, since the middle portion 31*e* has the highest hardness, it is preferable to be used for a portion requiring high mechanical strength. In addition, the unprocessed portion 31*f* and the diameter-increasing portion 31*c* having relatively low hardness are preferable to be used as portions requiring post-working such as bending.

In addition, the inner surface of the middle portion 31*e* has small surface roughness by being subjected to ironing. If the surface roughness is reduced, fatigue properties increase. Accordingly, in addition to improvement of strength due to work hardening, the middle portion 31*e* can also achieve improvement of fatigue properties due to the reduced surface roughness on the inner surface, thereby realizing weight reduction and high strength. Such a synergistic effect cannot be achieved in thinning through simple cutting.

Figure 3:
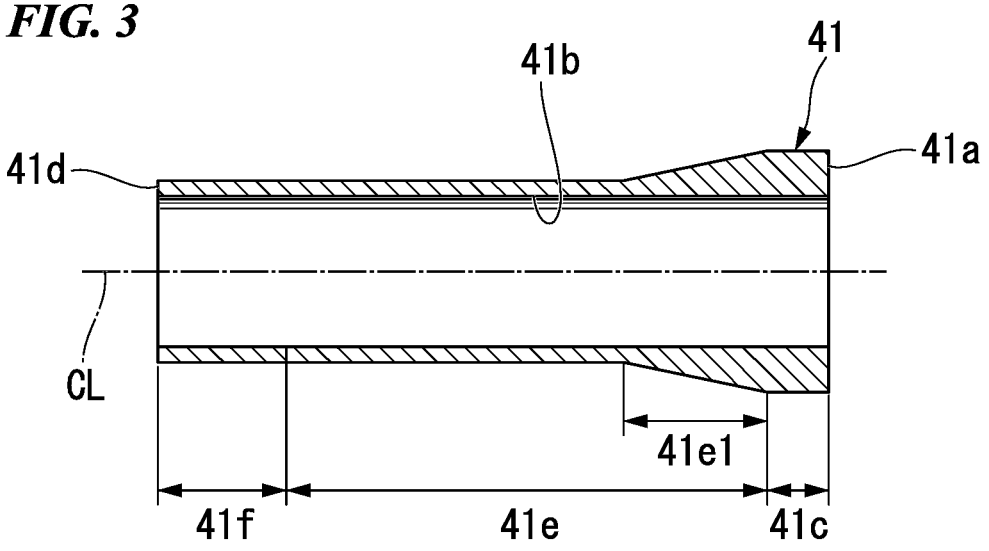
FIG. 3 is a view showing another example of a variable wall thickness steel pipe manufactured by the method of manufacturing a variable wall thickness steel pipe of the same embodiment and is a cross-sectional view seen in a cross section including the axis.

In addition, FIG. 3 shows another example of a variable wall thickness steel pipe manufactured via the steps shown in FIGS. 1(*a*) to 1(*c*). A variable wall thickness steel pipe 41 shown in FIG. 3 is a variable wall thickness steel pipe manufactured by thrusting the plug 21 until the large-diameter base end portion 21*b* of the plug 21 reaches the other end portion 1*d* of the raw pipe 1, in the step shown in FIG. 1(*c*).

The variable wall thickness steel pipe 41 shown in FIG. 3 is configured to include the diameter-increasing portion 41*c* (1*c*) which is located on one end portion 41*a* side and is increased in diameter from the raw pipe 1, a middle portion 41*e* (1*e*) which is located between the one end portion 41*a* (1*a*) and the other end portion 41*d* (1*d*) and is subjected to ironing, and the other end part 41*f* which is located on the other end portion 41*d* side of the middle portion 41*e* and is subjected to ironing, similar to the middle portion 41*e*. The middle portion 41*e* also includes a part subjected to working by the tapered portion 11*c* of the die 11 and the tapered portion 21*c* of the plug 21 at a boundary with respect to the diameter-increasing portion 41*c*. That is, the middle portion 41*e* includes a lock portion 41*e*1 (1*e*1). Since the lock portion 41*e*1 has the same shape as the lock portion 31*e*1, a duplicate description thereof will be omitted herein.

In a hollow portion 41*b* of the variable wall thickness steel pipe 41, the entire inner diameter in its longitudinal direction is further increased than the inner diameter $d_2$ of the raw pipe 1. In addition, the outer diameter of the variable wall thickness steel pipe 41 is gradually increased from the outer diameter $d_1$ of the raw pipe 1 in the lock portion 41*e*1. Then, in the diameter-increasing portion 41*c*, the outer diameter thereof is constant while being further increased than the outer diameter $d_1$ of the raw pipe 1. Meanwhile, a part excluding the lock portion 41*e*1 in the middle portion 41*e*, and the other end part 41*f* remain having an outer diameter equal to the outer diameter $d_1$ of the raw pipe 1. Accordingly, the variable wall thickness steel pipe 41 has a comparatively great thickness in the lock portion 41*e*1 and the diameter-increasing portion 41*c* and has a comparatively small thickness in a part excluding the lock portion 41*e*1 in the middle portion 41*e*, and the other end part 41*f*.

In the variable wall thickness steel pipe 41 shown in FIG. 3, since a small working amount is applied to the diameter-increasing portion 41*c*, no work hardening has occurred in this part, or even if work hardening has occurred, it is very insignificant. Therefore, the diameter-increasing portion 41*c* has comparatively low strength. Accordingly, even in a case where post-working such as bending is performed with respect to this part, annealing treatment or the like for softening work hardening becomes unnecessary.

In addition, since a large working amount is applied to the middle portion 41*e* and the other end part 41*f* of the variable wall thickness steel pipe 41, the middle portion 41*e* and the other end part 41*f* have comparatively high strength due to work hardening.

As described above, in the embodiment shown in FIGS. 1(*a*) to 2, the lock portion 1*e*1 and the diameter-increasing portion 1*c* are provided by performing pipe expanding with respect to the one end portion 1*a* of the raw pipe 1, and ironing is performed with respect to the middle portion 1*e* on the other end portion 1*d* side of the diameter-increasing portion 1*c* of the raw pipe 1 such that the inner diameter is increased while the outer diameter of the raw pipe 1 is maintained, by further thrusting the plug 21 into the raw pipe 1 while the lock portion 1*e*1 is locked inside the die 11. Therefore, the working amount with respect to the diameter-increasing portion 1*c* can be reduced, so that heat treatment such as annealing can be made unnecessary when post-working such as bending is performed with respect to the diameter-increasing portion 1*c*.

In addition, since ironing is performed by thrusting the plug 21 into the raw pipe 1 while the diameter-increasing portion 1*c* is locked in the die 11, ironing can be carried out by only relatively moving the die 11 and the plug 21 without requiring labor and tools for fixing the raw pipe 1 itself.

In addition, since a part of the raw pipe 1 on the other end portion 1*d* side of the middle portion 1*e* is caused to be the unprocessed portion 31*f* which remains unprocessed, the working amount with respect to a part on the other end portion 1*d* side becomes zero, so that heat treatment such as annealing can be made unnecessary when post-working such as bending is performed with respect to the unprocessed portion 31*f*.

In addition, in the variable wall thickness steel pipe 31 manufactured by the method described above, since the diameter-increasing portion 31*c* and the unprocessed portion 31*f* have a small working amount, the thickness is large and strength is comparatively low. Meanwhile, in the middle portion 31*e*, since the working amount thereof is large, the thickness is small and strength is comparatively high. Therefore, the diameter-increasing portion 31*c* and the unprocessed portion 31*f* are in a state where deformability remains, compared to the middle portion 31*e*, and these parts form the variable wall thickness steel pipe 31 having excellent post-workability such as bending. In addition, since the middle portion 31*e* has small inner surface roughness by being subjected to ironing, this part forms the variable wall thickness steel pipe 31 having excellent fatigue properties.

Second Embodiment

A method of manufacturing a variable wall thickness steel pipe of a second embodiment is configured to include a step of forming a diameter-increasing portion by performing pipe expanding with respect to a part on one end side of a raw pipe using a die and a plug, and a step of ironing a middle portion on the other end side of the diameter-increasing portion such that the inner diameter of the raw pipe is increased while the outer diameter is maintained after the plug is replaced with another plug. A raw pipe as a working target of the present embodiment may be similar to that of the first embodiment.

In the present embodiment, a die and a plug similar to those of the first embodiment are used in the step of forming the diameter-increasing portion, which is performed first.

Figure 4:
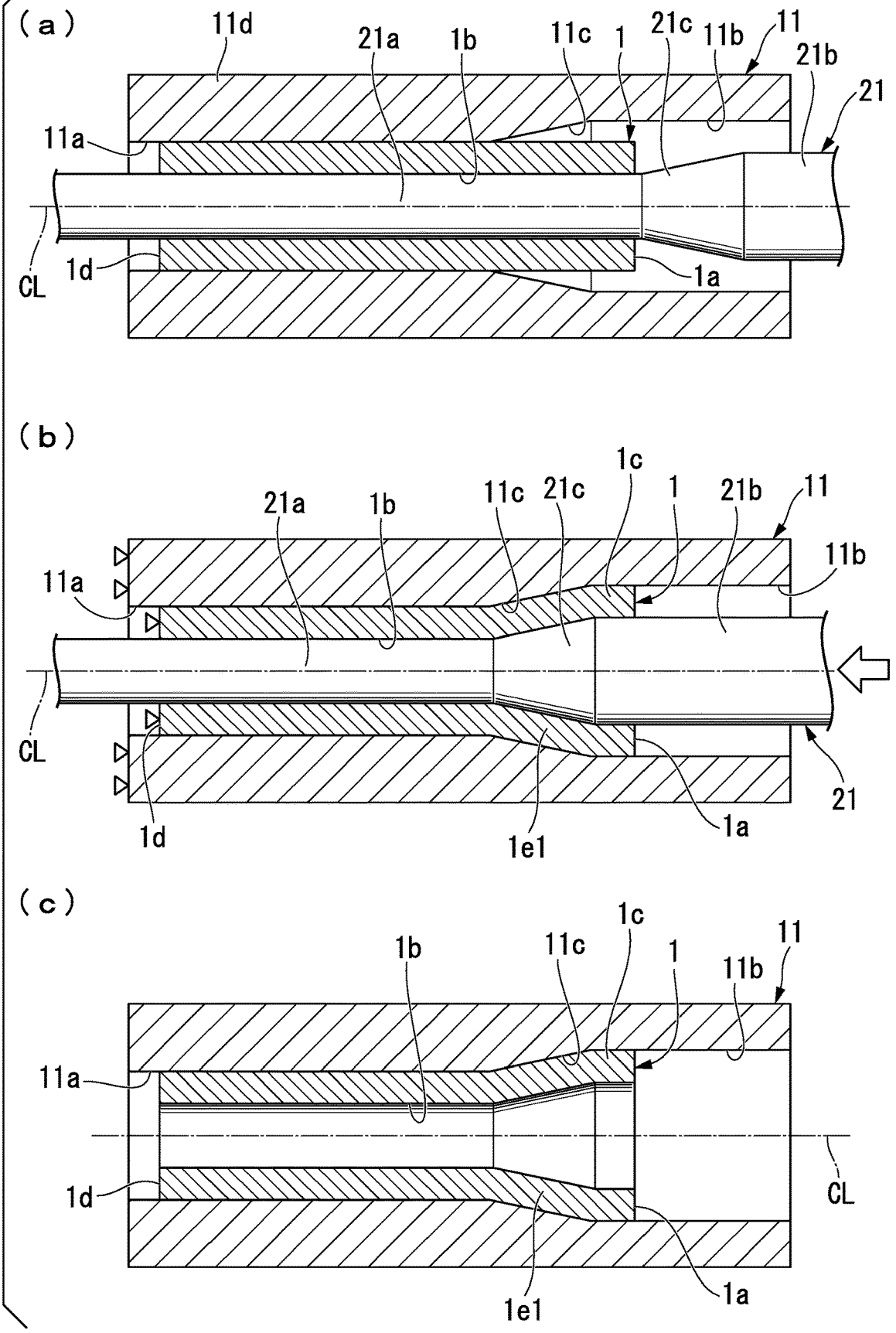
FIG. 4 is a process drawing showing a method of manufacturing a variable wall thickness steel pipe according to a second embodiment of the present invention and is a cross-sectional view seen in a cross section including an axis of a raw pipe.

That is, similar to the case of the first embodiment, as shown in FIG. 4(*a*), the raw pipe 1 is inserted into the die 11, and positional alignment is performed such that the one end portion 1*a* of the raw pipe 1 is positioned inside the hollow large-diameter portion 11*b* of the die 11. Each of the die 11 and the raw pipe 1 are in a fixed state. Then, the small-diameter tip end portion 21*a* of the plug 21 is inserted into the hollow portion 1*b* of the raw pipe 1 from the one end portion 1*a* side of the raw pipe 1.

Next, as shown in FIG. 4(*b*), as the diameter-increasing step, while the die 11 and the raw pipe 1 are in a fixed state, the tapered portion 21*c* and the large-diameter base end portion 21*b* of the plug 21 are thrust into the one end portion 1*a* of the raw pipe 1. The plug 21 is thrust until the tapered portion 21*c* reaches the position of the tapered portion 11*c* of the die 11. Accordingly, similar to the first embodiment, the lock portion 1*e*1 and the diameter-increasing portion 1*c* are formed in the one end portion 1*a* of the raw pipe 1.

Next, as shown in FIG. 4(*c*), the thrust plug 21 is pulled out from the raw pipe 1 to be replaced with another plug. Meanwhile, the die 11 is continuously used to the end without being replaced.

Figure 5:
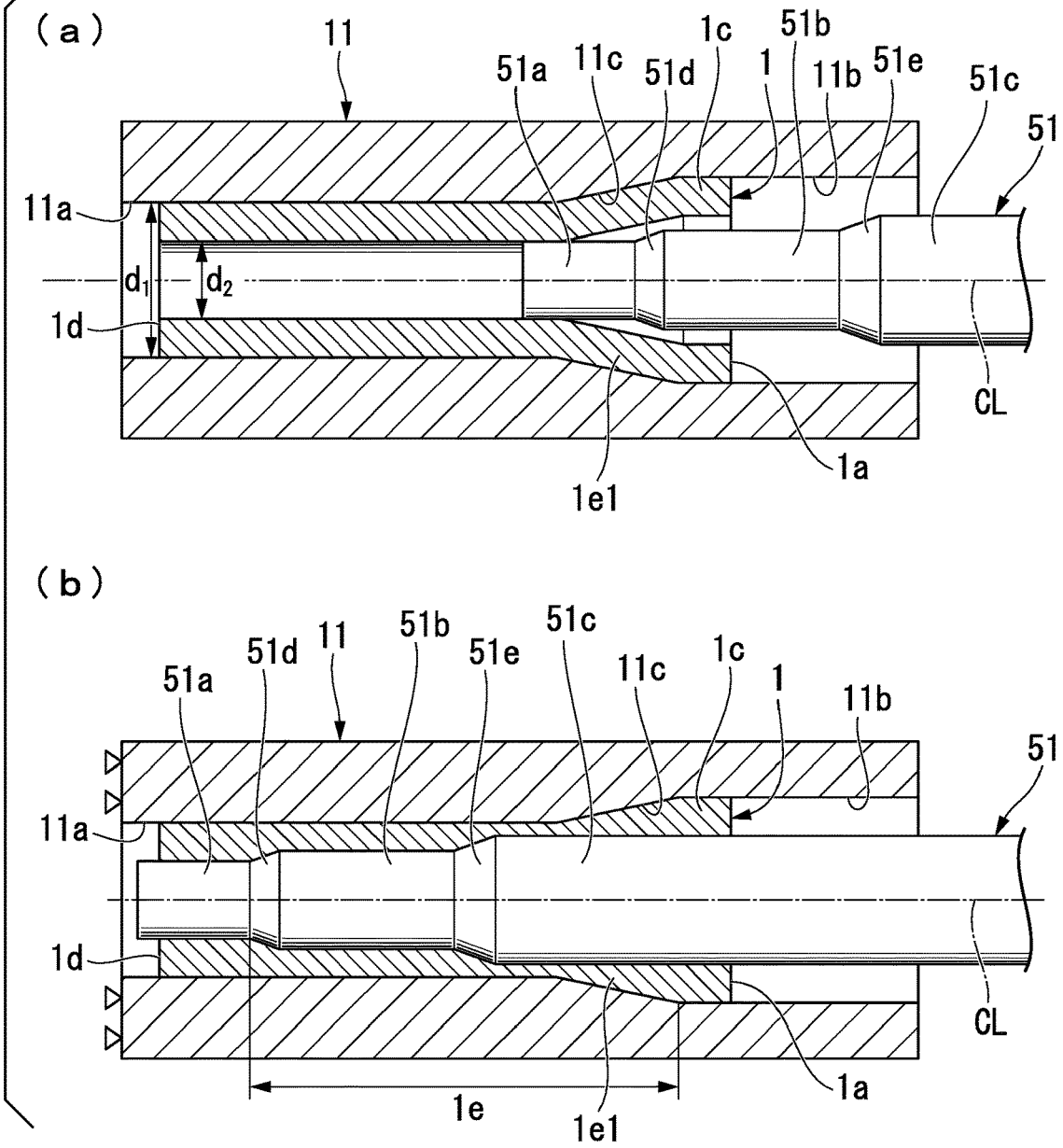
FIG. 5 is a process drawing showing a subsequent process of the method of manufacturing a variable wall thickness steel pipe according to the same embodiment and is a cross-sectional view seen in a cross section including the axis of the raw pipe.

Next, as shown in FIG. 5(*a*), a different plug 51 is prepared. The different plug 51 includes a small-diameter tip end portion 51*a* corresponding to the inner diameter $d_2$ of the raw pipe 1, an intermediate-diameter portion 51*b* having a diameter larger than the inner diameter $d_2$ of the raw pipe 1 or the outer diameter of the small-diameter tip end portion 51*a*, a large-diameter base end portion 51*c* having a diameter larger than the diameter of the intermediate-diameter portion 51*b*, a first tapered portion 51*d* being provided between the small-diameter tip end portion 51*a* and the intermediate-diameter portion 51*b*, and a second tapered portion 51*e* being provided between the intermediate-diameter portion 51*b* and the large-diameter base end portion 51*c*. In addition, the diameter of the large-diameter base end portion 51*c* is set to have a size smaller than the inner diameter $d_1$ of the hollow small-diameter portion 11*a* of the die 11. In addition, the diameter of the small-diameter tip end portion 51*a* of the plug 51 has the same size as the diameter of the small-diameter tip end portion 21*a* of the plug 21 used previously.

Then, as shown in FIG. 5(*b*), as the ironing step, in a state where the fixed state of the raw pipe 1 is released, whereas the fixed state of the die 11 is maintained, the plug 51 is thrust from the one end portion 1*a* of the raw pipe 1 toward the other end portion 1*d*. As the plug 51 is thrust, the raw pipe 1 is pushed from the one end portion 1*a* toward the other end portion 1*d* side. However, since the lock portion 1*e*1 formed in the raw pipe 1 in the previous step remains locked in the tapered portion 11*c* of the die 11, the raw pipe 1 does not move. In the present embodiment, the plug 51 is thrust until the tip end of the small-diameter tip end portion 51*a* protrudes from the other end portion 1*d* of the raw pipe 1.

As the plug 51 is thrust to the position shown in FIG. 5(*b*), the intermediate-diameter portion 51*b* and the large-diameter base end portion 51*c* of the plug 51 are thrust into the middle portion 1*e* of the raw pipe 1. In the middle portion 1*e* of the raw pipe 1, the original inner diameter $d_2$ of the raw pipe 1 is increased to a size corresponding to the diameters of the intermediate-diameter portion 51*b* and the large-diameter base end portion 51*c* of the plug 51. On the other hand, since the middle portion 1*e* of the raw pipe 1 is positioned inside the hollow small-diameter portion 11*a* of the die 11, the outer diameter $d_1$ of the middle portion 1*e* is not increased. Therefore, the middle portion 1*e* of the raw pipe 1 is subjected to ironing while the original outer diameter $d_1$ of the raw pipe 1 is maintained, excluding a part of the lock portion 1*e*1.

In addition, as shown in FIG. 5(*b*), a part on the other end portion 1*d* side of the middle portion 1*e* of the raw pipe 1 is only a part into which the small-diameter tip end portion 51*a* is inserted, so that the part remains unprocessed.

Figure 6:
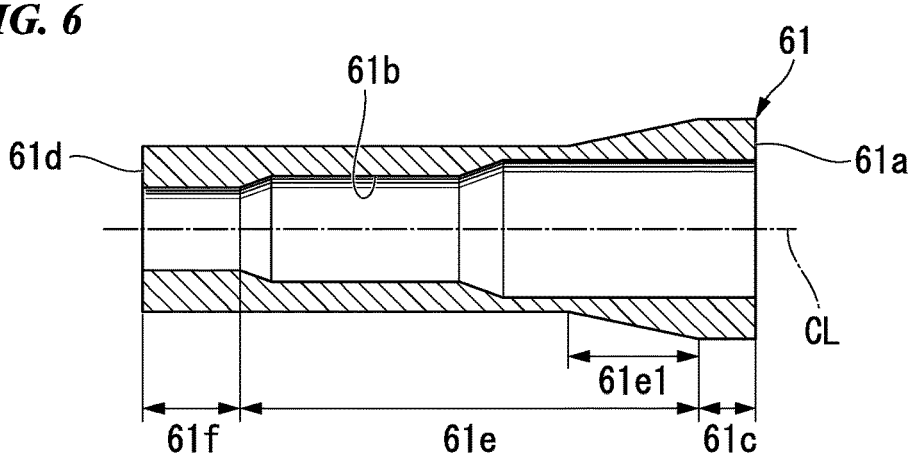
FIG. 6 is a view showing a variable wall thickness steel pipe manufactured by the method of manufacturing a variable wall thickness steel pipe according to the same embodiment and is a cross-sectional view seen in a cross section including the axis.

FIG. 6 shows a schematic cross-sectional view of a variable wall thickness steel pipe 61 manufactured via the steps shown in FIGS. 4(*a*) to 5(*b*). The variable wall thickness steel pipe 61 shown in FIG. 6 is configured to include the diameter-increasing portion 61*c* (1*c*) which is located on one end portion 61*a* side and is increased in diameter from the raw pipe 1, a middle portion 61*e* (1*e*) which is located between the one end portion 61*a* (1*a*) and the other end portion 61*d* (1*d*) and is subjected to ironing, and an unprocessed portion 61*f* which is located on the other end portion 61*d* side of the middle portion 61*e* and remains unprocessed as the raw pipe 1. The middle portion 61*e* also includes a part subjected to working by the tapered portion 11*c* of the die 11 and the tapered portions 51*d* and 51*e* of the plug 51 at each of boundaries with respect to the diameter-increasing portion 61*c* and the unprocessed portion 61*f*. That is, the middle portion 61*e* includes a lock portion 61*e*1 (1*e*1). Since the lock portion 61*e*1 has the same shape as the lock portion 31*e*1, a duplicate description thereof will be omitted herein.

In the diameter-increasing portion 61*c* and the middle portion 61*e*, the inner diameter of a hollow portion 61*b* of the variable wall thickness steel pipe 61 is further increased than the inner diameter $d_2$ of the raw pipe 1. Then, in the unprocessed portion 61*f*, the inner diameter of a hollow portion 61*b* of the variable wall thickness steel pipe 61 remains the inner diameter $d_2$ of the raw pipe 1. In addition, in the middle portion 61*e*, the inner diameter of a part on the one end portion 61*a* side is increased by the large-diameter base end portion 51*c* of the plug 51, and the inner diameter of a part on the other end portion 61*d* side is increased by the intermediate-diameter portion 51*b* of the plug 51. Furthermore, inner diameter of a part on the one end portion 61*a* side and the inner diameter of a part on the other end portion 61*d* side are different from each other. In addition, in the lock portion 61*e*1 and the diameter-increasing portion 61*c*, the outer diameter of the variable wall thickness steel pipe 61 is further increased than the outer diameter $d_1$ of the raw pipe 1. Meanwhile, the outer diameters of a part excluding the lock portion 61*e*1 in the middle portion 61*e*, and the unprocessed portion 61*f* remain unchanged as the outer diameter $d_1$ of the raw pipe 1. Accordingly, the variable wall thickness steel pipe 61 has a comparatively great thickness in the diameter-increasing portion 61*c* and the unprocessed portion 61*f* and has a comparatively small thickness in the middle portion 61*e*.

In the variable wall thickness steel pipe 61 shown in FIG. 6, since a small working amount is applied to the diameter-increasing portion 61*c* and the unprocessed portion 61*f*, no work hardening has occurred in these parts, or even if work hardening has occurred, it is very insignificant. Therefore, the diameter-increasing portion 61*c* or the unprocessed portion 61*f* has comparatively low strength. Accordingly, even in a case where post-working such as bending is performed with respect to these parts, annealing treatment or the like for softening work hardening becomes unnecessary.

In addition, since a comparatively large working amount is applied to the middle portion 61*e* of the variable wall thickness steel pipe 61, the middle portion 61*e* has comparatively high strength due to work hardening.

In the present embodiment as described above, ironing is performed with respect to the middle portion 1*e* of the raw pipe 1 using the plug 51. In this case, in the middle portion 1*e*, the diameter-increasing amount of a region on the diameter-increasing portion 1*c* side is larger than the diameter-increasing amount of a region on the other end portion 1*d* side, so that two regions of which the inner diameters and strengths are different from each other can be provided inside the middle portion 1*e*.

In addition, the variable wall thickness steel pipe 61 manufactured by the method described above has the middle portion 61*e* in which the diameter-increasing amount of a region on the diameter-increasing portion 61*c* side is larger than the diameter-increasing amount of a region on the other end portion 61*d* side, and the working amount of a region on the diameter-increasing portion 61*c* side is larger than the working amount of a region on the other end portion 61*d* side. Therefore, the variable wall thickness steel pipe 61 has regions of which the thicknesses and strength are different from each other in the middle portion 61*e*.

Third Embodiment

A method of manufacturing a variable wall thickness steel pipe of a third embodiment will be described with reference to FIGS. 7(*a*) to 7(*c*). The method of manufacturing a variable wall thickness steel pipe of the present embodiment is configured to include a step similar to that of the first embodiment. In the present embodiment, the variable wall thickness steel pipe is manufactured by using a plug 71 which is different from the plug 21 used in the first embodiment. Since other configurations are similar to those of the first embodiment, a description will be omitted.

Figure 7:
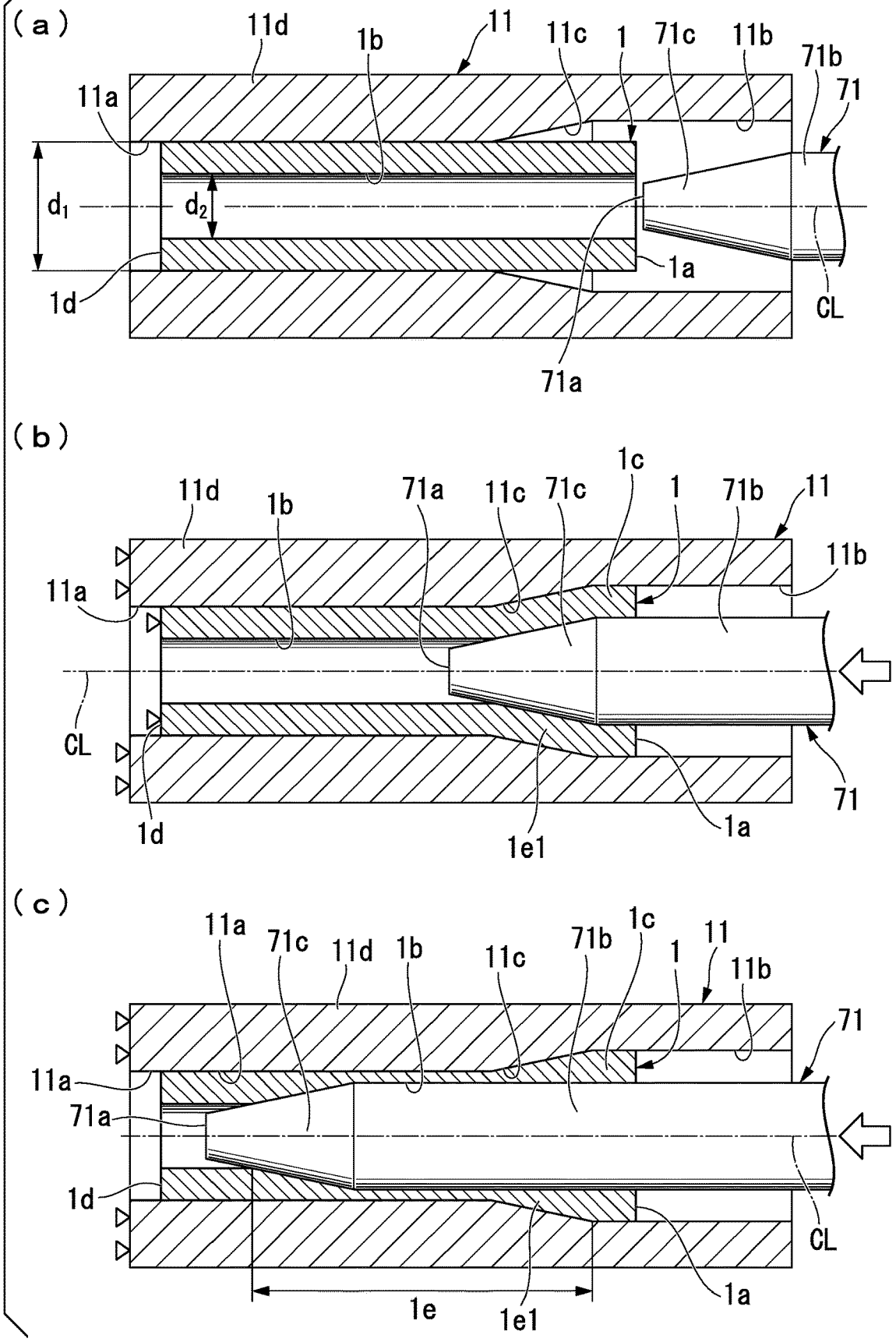
FIG. 7 is a process drawing showing a method of manufacturing a variable wall thickness steel pipe according to a third embodiment of the present invention and is a cross-sectional view seen in a cross section including an axis of a raw pipe.

As shown in FIG. 7(*a*), the plug 71 used in the present embodiment is configured to include a tapered tip end portion 71*c* having a tip end portion 71*a* smaller than the inner diameter $d_2$ of the raw pipe 1, and a base end portion 71*b* having a diameter larger than the inner diameter $d_2$ of the raw pipe 1. In addition, the diameter of the base end portion 71*b* is set to have a size smaller than the inner diameter $d_1$ of the hollow small-diameter portion 11*a* of the die 11.

In the present embodiment, similar to the first embodiment, as shown in FIG. 7(*b*), as the diameter-increasing step, while the die 11 and the raw pipe 1 are in a fixed state, the tapered tip end portion 71*c* and the base end portion 71*b* of the plug 71 are thrust into the one end portion 1*a* of the raw pipe 1. The plug 71 is thrust until the tapered tip end portion 71*c* reaches the position of the tapered portion 11*c* of the die 11. Accordingly, the lock portion 1*e*1 and the diameter-increasing portion 1*c* are formed in the one end portion 1*a* of the raw pipe 1.

Next, as shown in FIG. 7(*c*), as the ironing step, in a state where the fixed state of the raw pipe 1 is released, whereas the fixed state of the die 11 is maintained, the plug 71 is further thrust toward the other end portion 1*d* side of the raw pipe 1. As the plug 71 is further thrust, the raw pipe 1 is pushed from the one end portion 1*a* toward the other end portion 1*d* side. However, since the lock portion 1*e*1 formed in the raw pipe 1 in the previous step remains locked in the tapered portion 11*c* of the die 11, the raw pipe 1 does not move.

Since the plug 71 in the present embodiment is configured to include the tapered tip end portion 71*c* and the base end portion 71*b* and does not include the small-diameter tip end portion 21*a* shown in the first embodiment, its length in the longitudinal direction is comparatively short. Therefore, compared to the first embodiment, the required stroke amount of the plug 71 when inserting the plug 71 into the raw pipe 1 or when pulling out the plug 71 from the raw pipe 1 becomes short. As a result, the work hour for taking out and putting in the plug 71 can be shortened, and a hydraulic cylinder (not shown) having a simple structure for taking out and putting in the plug 71 can be employed. Therefore, it is possible to perform working even with comparatively small manufacturing equipment.

The variable wall thickness steel pipe which has been manufactured via the steps shown in FIGS. 7(*a*) to 7(*c*) has a shape similar to that of the variable wall thickness steel pipe 31 shown in FIG. 2. In addition, in the step shown in FIG. 7(*c*), the variable wall thickness steel pipe may be worked into a shape similar to the variable wall thickness steel pipe 41 as shown in FIG. 3 by thrusting the plug 71 until the base end portion 71*b* of the plug 71 reaches the other end portion 1*d* of the raw pipe 1.

In the present embodiment as described above, since the variable wall thickness steel pipe is manufactured by using the plug 71 having a comparatively short length in the longitudinal direction, compared to the first embodiment, it is possible to comparatively reduce the required stroke amount of the plug 71 at the time of manufacturing.

Fourth Embodiment

Next, a method of manufacturing a variable wall thickness steel pipe of a fourth embodiment will be described. The method of manufacturing a variable wall thickness steel pipe of the present embodiment is configured to include a step similar to that of the second embodiment. In the present embodiment, ironing is performed by using a plug 81 different from the plug 51 used in the ironing step of the second embodiment. Since other configurations are similar to those of the second embodiment, a description will be omitted.

Figure 8:
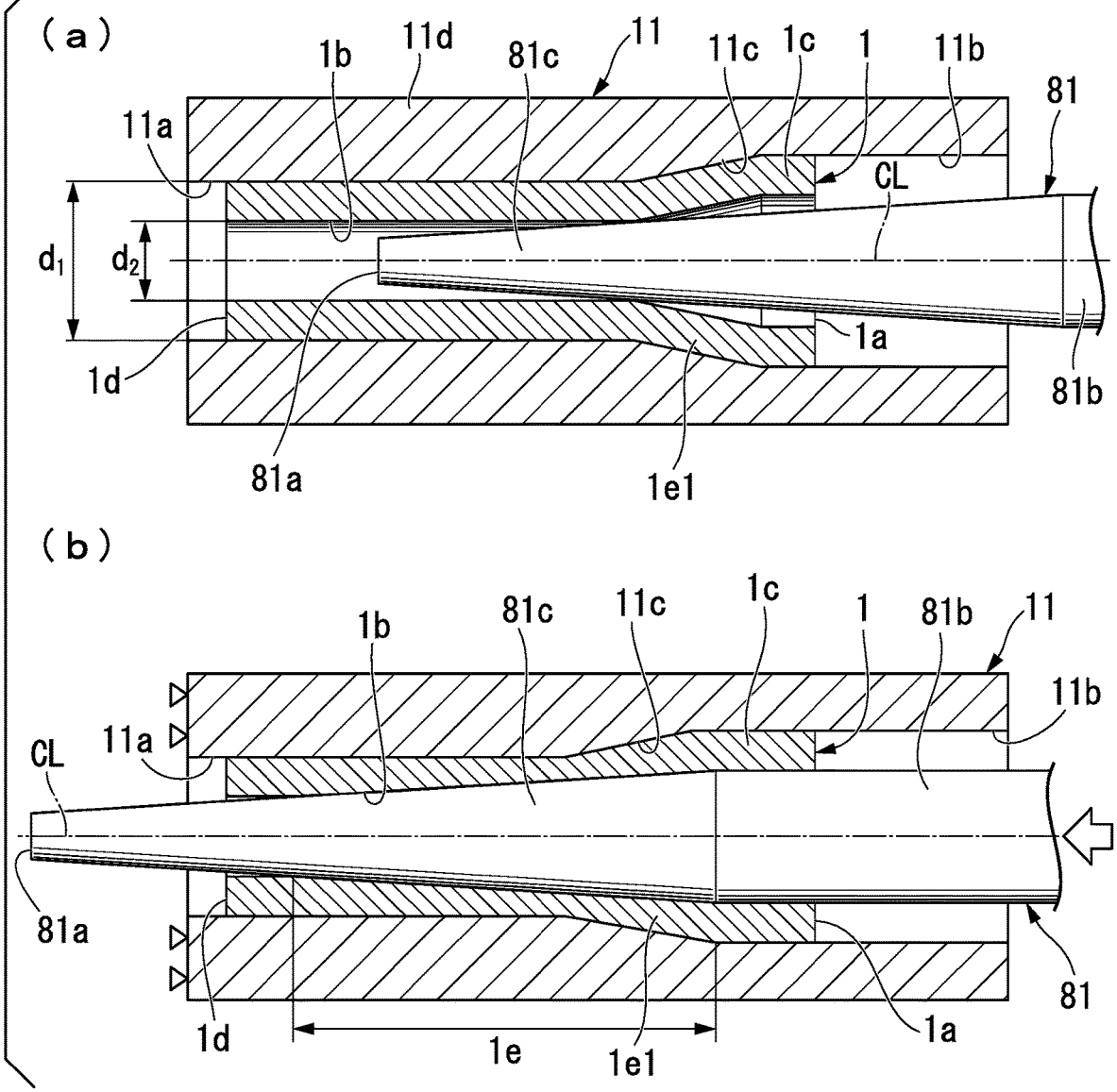
FIG. 8 is a process drawing showing a method of manufacturing a variable wall thickness steel pipe according to a fourth embodiment of the present invention and is a cross-sectional view seen in a cross section including an axis of a raw pipe.

First, in the present embodiment, similar to the second embodiment, the lock portion 1*e*1 and the diameter-increasing portion 1*c* are formed in the raw pipe 1. Next, as shown in FIG. 8(*a*), the plug 81 different from that in the previous step is prepared. The plug 81 is configured to include a tapered tip end portion 81*c* having a tip end portion 81*a* smaller than the inner diameter $d_2$ of the raw pipe 1, and a base end portion 81*b* having a diameter larger than the inner diameter $d_2$ of the raw pipe 1 and a diameter smaller than the inner diameter $d_1$ of the hollow small-diameter portion 11*a* of the die 11. The tapered tip end portion 81*c* of the plug 81 is longer than the length of the tapered tip end portion 71*c* of the plug 71 shown in FIG. 7(*a*).

Then, as shown in FIG. 8(*b*), as the ironing step, in a state where the fixed state of the raw pipe 1 is released, whereas the fixed state of the die 11 is maintained, the plug 81 is thrust from the one end portion 1*a* of the raw pipe 1 toward the other end portion 1*d*. As the plug 81 is thrust, the raw pipe 1 is pushed from the one end portion 1*a* toward the other end portion 1*d* side. However, since the lock portion 1*e*1 formed in the raw pipe 1 in the previous step remains locked in the tapered portion 11*c* of the die 11, the raw pipe 1 does not move. In the present embodiment, the plug 81 is thrust until the tip end portion 81*a* of the plug 81 protrudes from the other end portion 1*d* of the raw pipe 1.

As the plug 81 is thrust to the position shown in FIG. 8(*b*), the tapered tip end portion 81*c* of the plug 81 is thrust into the middle portion 1*e* of the raw pipe 1. In the middle portion 1*e* of the raw pipe 1, the original inner diameter $d_2$ of the raw pipe 1 is increased to a size corresponding to the diameter of the tapered tip end portion 81*c* of the plug 81.

Since the plug 81 used in the present embodiment includes the tapered tip end portion 81*c* having a comparatively long taper length, the inner diameter of the middle portion 1*e* of the raw pipe 1 becomes the same as the outer diameter of the tapered tip end portion 81*c* of the plug 81 over the entire length. That is, the inner diameter of the middle portion 1*e* of the raw pipe 1 is gradually increased from the other end portion 1*d* side to the one end portion 1*a* side.

Figure 9:
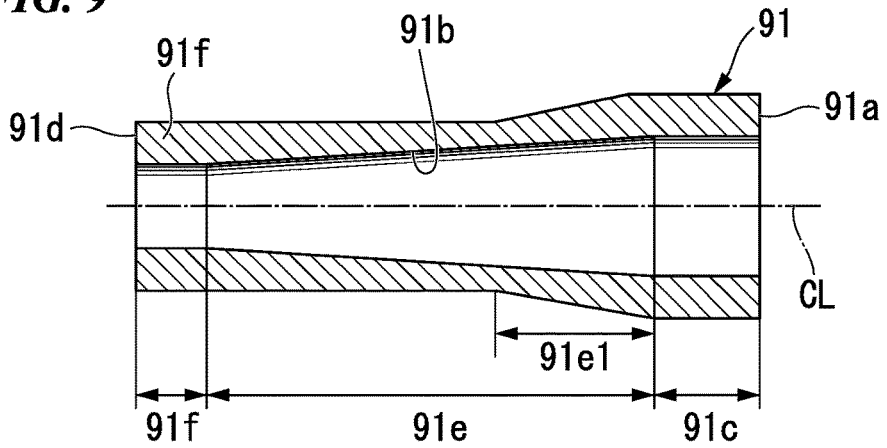
FIG. 9 is a view showing a variable wall thickness steel pipe manufactured by the method of manufacturing a variable wall thickness steel pipe according to the same embodiment and is a cross-sectional view seen in a cross section including the axis of the raw pipe.

FIG. 9 shows a schematic cross-sectional view of the variable wall thickness steel pipe manufactured in accordance with the present embodiment. A variable wall thickness steel pipe 91 shown in FIG. 9 is configured to include a diameter-increasing portion 91*c* (1*c*) which is located on one end portion 91*a* (1*a*) side and is increased in diameter from the raw pipe 1, a middle portion 91*e* (1*e*) which is located between the one end portion 91*a* and the other end portion 91*d* (1*d*) and is subjected to ironing, and an unprocessed portion 91*f* which is located on the other end portion 91*d* side of the middle portion 91*e* and remains unprocessed as the raw pipe 1.

In the diameter-increasing portion 91*c* and the middle portion 91*e*, the inner diameter of a hollow portion 91*b* of the variable wall thickness steel pipe 91 is further increased than the inner diameter $d_2$ of the raw pipe 1. In the unprocessed portion 91*f*, the inner diameter $d_2$ of the raw pipe remains unchanged. In addition, in a lock portion 91*e*1 and the diameter-increasing portion 91*c*, the outer diameter of the variable wall thickness steel pipe 91 is further increased than the outer diameter $d_1$ of the raw pipe 1. A part excluding the lock portion 91*e*1 in the middle portion 91*e*, and the unprocessed portion 91*f* remain unchanged as the outer diameter $d_1$ of the raw pipe 1. In addition, the inner diameter in the middle portion 91*e* gradually increases from the other end portion 1*d* side to the one end portion 1*a* side. Accordingly, the diameter-increasing portion 91*c* and the unprocessed portion 91*f* have a comparatively great thickness. In addition, in a case where the thickness of the middle portion 91*e* is seen from the diameter-increasing portion 91*c* toward the unprocessed portion 91*f*, the thickness is gradually reduced in the lock portion 91e1 and gradually increases in parts other than the lock portion 91e1.

In the variable wall thickness steel pipe 91 shown in FIG. 9, since a small working amount is applied to the diameter-increasing portion 91c and the unprocessed portion 91f, no work hardening has occurred in these parts, or even if work hardening has occurred, it is very insignificant.

In addition, in the middle portion 91e of the variable wall thickness steel pipe 91, since the working amount is gradually reduced from the diameter-increasing portion 91c to the unprocessed portion 91f, hardness is comparatively high on the diameter-increasing portion 91c side of the middle portion 91e, and hardness is comparatively low on the unprocessed portion 91f side.

As described above, in the present embodiment, ironing is performed with respect to the middle portion 1e of the raw pipe 1 by using the plug 81 having the tapered tip end portion 81c which is comparatively long. Therefore, it is possible to manufacture the variable wall thickness steel pipe in which the inner diameter is gradually reduced from the diameter-increasing portion 1c side to the other end portion 1d side in the middle portion 1e.

Fifth Embodiment

A method of manufacturing a variable wall thickness steel pipe of a fifth embodiment is configured to include a step of forming diameter-increasing portions 1c and 1f by performing pipe expanding with respect to both end parts of the raw pipe 1 using one die and two plugs; a step of performing first ironing in which a plug 22 on the other end side is pulled while the plug 21 on one end side is inserted in the raw pipe 1, and the inner diameter of a middle portion 1g on the other end side of the diameter-increasing portion 1c on one end side is increased while the outer diameter of the raw pipe 1 is maintained; and a step of performing second ironing in which the plug 21 on one end side is pulled from the raw pipe 1, the plug 22 on the other end side is inserted into the raw pipe 1, and the inner diameter of a middle portion 1h on one end side of the diameter-increasing portion 1f on the other end side is increased while the outer diameter of the raw pipe 1 is maintained. The raw pipe 1 as a working target of the present embodiment may be similar to that of the first embodiment.

In the present embodiment, a die 12 shown in FIG. 10(a) is used. The die 12 is configured to include a hollow small-diameter portion 12b having an inner diameter corresponding to the outer diameter $d_1$ of the raw pipe 1, and a hollow large-diameter portion 12a and a hollow large-diameter portion 12d being provided on both sides of the hollow small-diameter portion 12b in the longitudinal direction and having an inner diameter larger than the outer diameter $d_1$ of the raw pipe 1. In addition, a tapered portion 12c is provided between the hollow small-diameter portion 12b and the hollow large-diameter portion 12a, and a tapered portion 12e is provided between the hollow small-diameter portion 12b and the hollow large-diameter portion 12d. The hollow large-diameter portion 12a, the tapered portion 12c, the hollow small-diameter portion 12b, the tapered portion 12e, and the hollow large-diameter portion 12d communicate with each other inside a die main body 12f. In addition, the die 12 has a two-division structure which can be divided in an upward/downward direction in FIG. 10(a).

The one-dot chained lines vertically shown in FIGS. 10(a) to 10(d) are center lines indicating half the length of the die 12 in the longitudinal direction, and the die 12 has a line symmetric shape having this one-dot chained line as a symmetric axis.

Since the plug 21 shown in FIG. 10(a) is similar to that used in the first embodiment, the same reference sign is applied and description is omitted. The plug 22 has a shape similar to the plug 21 and is configured to include a small-diameter tip end portion 22a corresponding to the inner diameter $d_2$ of the raw pipe 1, a large-diameter base end portion 22b having a diameter larger than the inner diameter $d_2$ of the raw pipe 1, and a tapered portion 22c being provided between the small-diameter tip end portion 22a and the large-diameter base end portion 22b. In addition, the diameter of the large-diameter base end portion 22b is set to have a size smaller than the inner diameter $d_1$ of the hollow small-diameter portion 12b of the die 12.

In order to manufacture the variable wall thickness steel pipe according to the present embodiment, first, as shown in FIG. 10(a), the raw pipe 1 is inserted into the die 12. At this time, positional alignment is performed such that the one end portion 1a and the other end portion 1d of the raw pipe 1 are respectively positioned in the hollow large-diameter portions 12a and 12d of the die 12. Then, the small-diameter tip end portion 21a of the plug 21 and the small-diameter tip end portion 22a of the plug 22 are inserted into the hollow portion 1b of the raw pipe 1 from the one end portion 1a side and the other end portion 1d side of the raw pipe 1, respectively. At this time, the raw pipe 1 and the die 12 are in a non-fixed state.

Next, as the diameter-increasing step, as shown in FIG. 10(b), the tapered portion 21c and the large-diameter base end portion 21b of the plug 21 are thrust into the one end portion 1a of the raw pipe 1, and the tapered portion 22c and the large-diameter base end portion 22b of the plug 22 are thrust into the other end portion 1d of the raw pipe 1, simultaneously. In addition, the plug 21 is thrust until the tapered portion 21c reaches the position of the tapered portion 12c of the die 12, and the plug 22 is thrust until the tapered portion 22c reaches the position of the tapered portion 12e of the die 12. Accordingly, a lock portion 1g1 and the diameter-increasing portion 1c are formed on the one end portion 1a side of the raw pipe 1. In addition, a lock portion 1h1 and the diameter-increasing portion 1f are formed on the other end portion 1d side.

Next, while the plug 21 on the one end portion 1a side remains unchanged, the plug 22 on the other end portion 1d side is pulled out from the raw pipe 1. Thereafter, as shown in FIG. 10(c), as the first ironing step, while the fixed state of the raw pipe 1 is released, whereas the other end portion 12g side of the die 12 is fixed, the plug 21 is further thrust toward the other end portion 1d side of the raw pipe 1. As the plug 21 is further thrust, the raw pipe 1 is pushed from the one end portion 1a toward the other end portion 1d side. However, since the lock portion 1g1 formed in the raw pipe 1 in the previous step remains locked in the tapered portion 12c of the die 12, the raw pipe 1 does not move.

In the example shown in FIG. 10(c), the tapered portion 21c and the large-diameter base end portion 21b of the plug 21 are thrust to the position on the one end portion 12h side of a middle position of the die 12. If thrusting of the plug 21 stops at the position as shown in FIG. 10(c), a part between the diameter-increasing portion 1f of the raw pipe 1 on the other end portion 1d side and a first working part 1g of the raw pipe 1 subjected to ironing remains unprocessed.

Next, the plug 21 pulled out from the raw pipe 1, and the plug 22 is inserted into the raw pipe 1 on the other end portion 1d side. Then, as shown in FIG. 10(d), as the second ironing step, the plug 22 is further thrust toward the one end portion 1*a* side of the raw pipe 1. At this time, the raw pipe 1 is in a non-fixed state, whereas the one end portion 12*h* side of the die is fixed. As the plug 22 is further thrust, the raw pipe 1 is pushed from the other end portion 1*d* side toward the one end portion 1*a* side. However, since the lock portion 1*h*1 formed in the raw pipe 1 in advance in the diameter-increasing step is locked in the tapered portion 12*e* of the die 12, the raw pipe 1 does not move.

Figure 10:
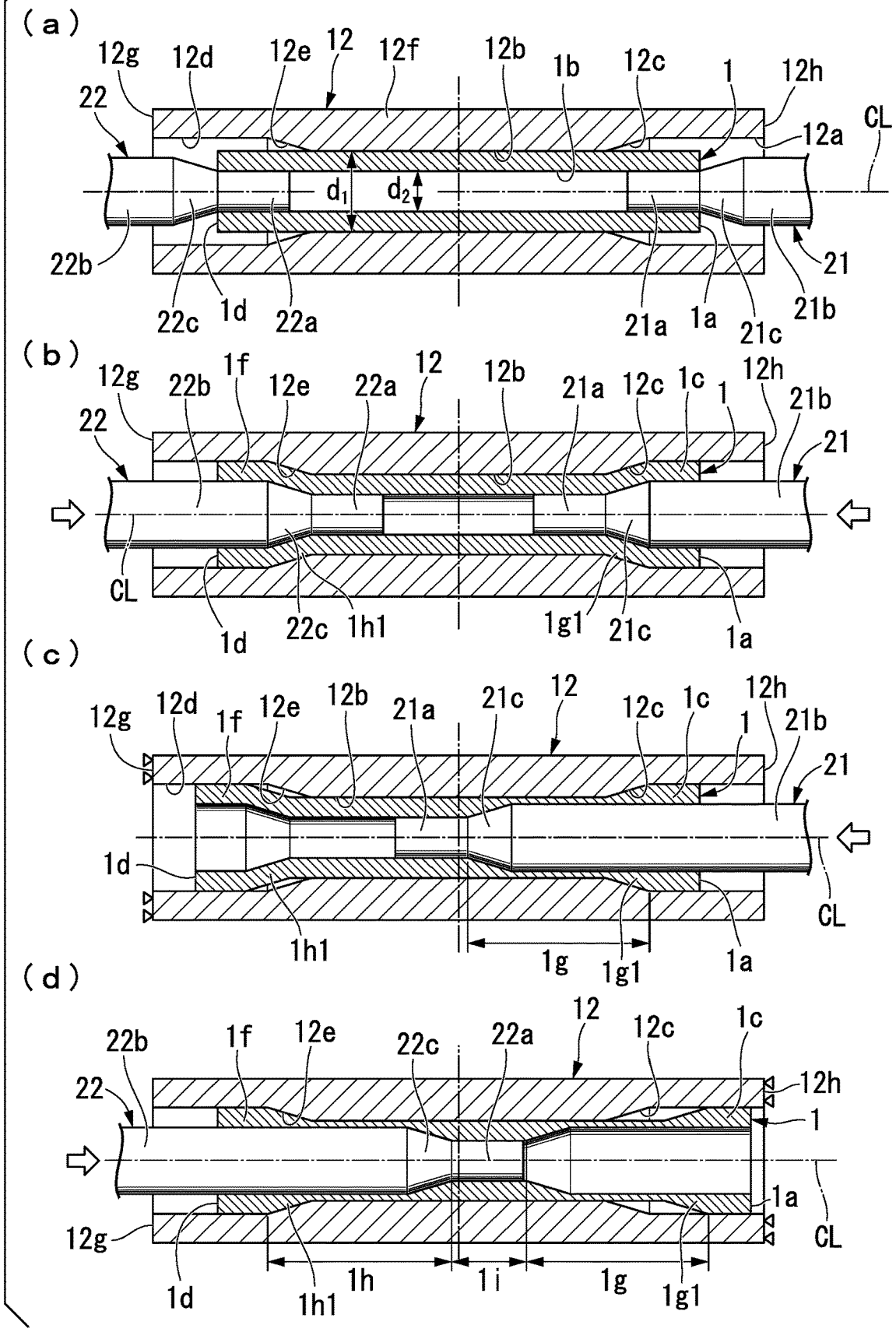
FIG. 10 is a process drawing showing a method of manufacturing a variable wall thickness steel pipe according to a fifth embodiment of the present invention and is a cross-sectional view seen in a cross section including an axis of a raw pipe.

In the example shown in FIG. 10(*d*), the tapered portion 22*c* and the large-diameter base end portion 22*b* of the plug 22 are thrust to the position on the other end portion 12*g* side of the middle of the die 12. If thrusting of the plug 22 stops at the position as shown in FIG. 10(*d*), a middle portion 1*i* between the first working part 1*g* and a second working part 1*h* of the raw pipe 1 remains unprocessed.

Figure 11:
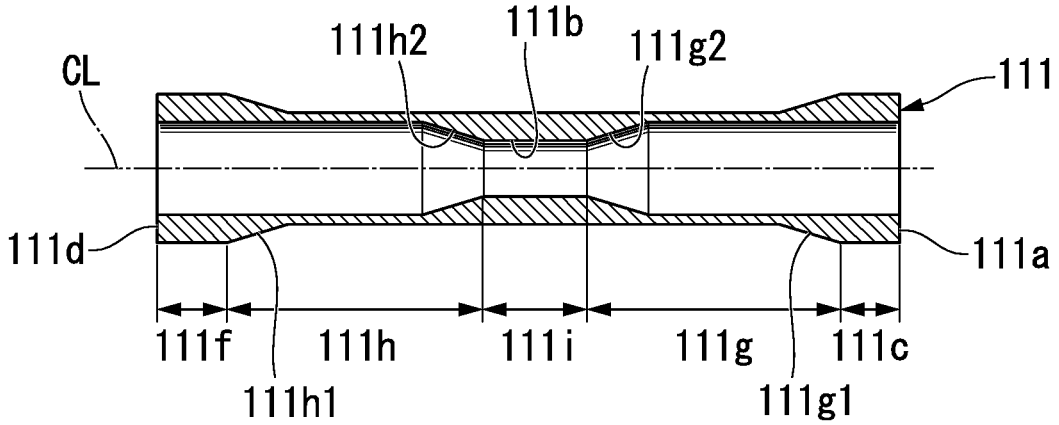
FIG. 11 is a view showing an example of a variable wall thickness steel pipe manufactured by the method of manufacturing a variable wall thickness steel pipe according to the same embodiment and is a cross-sectional view seen in a cross section including the axis of the raw pipe.

FIG. 11 shows a schematic cross-sectional view of a variable wall thickness steel pipe 111 manufactured via the steps shown in FIGS. 10(*a*) to 10(*d*). The variable wall thickness steel pipe 111 is configured to include the diameter-increasing portion 111*c* (1*c*) which is located on one end portion 111*a* (1*a*) side and is increased in diameter from the raw pipe 1, a first working part 111*g* (1*g*) which is located between the one end portion 111*a* and the other end portion 111*d* (1*d*) and is subjected to first ironing, the diameter-increasing portion 111*f* (1*f*) which is located on the other end portion 111*d* side and is increased in diameter from the raw pipe 1, a second working part 111*h* (1*h*) which is located between the other end portion 111*d* and the one end portion 111*a* and is subjected to second ironing, and an unprocessed portion 111*i* (1*i*) which is located between the first working part 111*g* and the second working part 111*h* and remains unprocessed as the raw pipe 1.

The first working part 11*g* also includes parts subjected to working by the tapered portions 12*c* and 21*c* of the die 12 and the plug 21 at each of boundaries with respect to the diameter-increasing portion 111*c* and the unprocessed portion 111*i*. That is, the first working part 111*g* includes a lock portion 111*g*1 (1*g*1) leading to the diameter-increasing portion 111*c*, and a tapered portion 111*g*2 leading to the unprocessed portion 111*i*.

The second working part 111*h* also includes parts subjected to working by the tapered portions 12*c* and 22*c* of the die 12 and the plug 22 at each of boundaries with respect to the diameter-increasing portion 111*f* and the unprocessed portion 111*i*. That is, the second working part 111*h* includes a lock portion 111*h*1 (1*h*1) leading to the diameter-increasing portion 111*f*, and a tapered portion 111*h*2 leading to the unprocessed portion 111*i*.

A hollow portion 111*b* of the variable wall thickness steel pipe 111 is further increased in diameter than the original inner diameter $d_2$ of the raw pipe 1 in the diameter-increasing portion 111*c*, the first working part 111*g*, the diameter-increasing portion 111*f*, and the second working part 111*h*. Meanwhile, in the unprocessed portion 111*i*, the original inner diameter $d_2$ of the raw pipe 1 remains unchanged. In addition, the outer diameter of the variable wall thickness steel pipe 111 is further increased than the outer diameter $d_1$ of the raw pipe 1 in the diameter-increasing portion 111*c*, a lock portion 111*g*1, the diameter-increasing portion 111*f*, and the lock portion 111*h*1. Meanwhile, a part excluding the lock portion 111*g*1 in the first working part 111*g*, a part excluding the lock portion 111*h*1 in the second working part 111*h*, and the unprocessed portion 111*i* remain unchanged as the outer diameter $d_1$ of the raw pipe 1.

In addition, in regard to the thickness, the variable wall thickness steel pipe has a comparatively great thickness in the diameter-increasing portion 111*c*, the diameter-increasing portion 111*f*, and the unprocessed portion 111*i* and has a comparatively small thickness in the first working part 111*g* and the second working part 111*h*.

In the variable wall thickness steel pipe 111 shown in FIG. 11, since a small working amount is applied to the diameter-increasing portion 111*c*, the diameter-increasing portion 111*f*, and the unprocessed portion 111*i*, no work hardening has occurred in these parts, or even if work hardening has occurred, it is very insignificant. Therefore, the diameter-increasing portion 111*c*, the diameter-increasing portion 111*f*, and the unprocessed portion 111*i* have comparatively low strength. Accordingly, even in a case where post-working such as bending is performed with respect to these parts, annealing treatment or the like for softening work hardening becomes unnecessary.

In addition, since a comparatively large working amount is applied to the first working part 111*g* and the second working part 111*h*, the first working part 111*g* and the second working part 111*h* have comparatively high strength due to work hardening.

Figure 12:
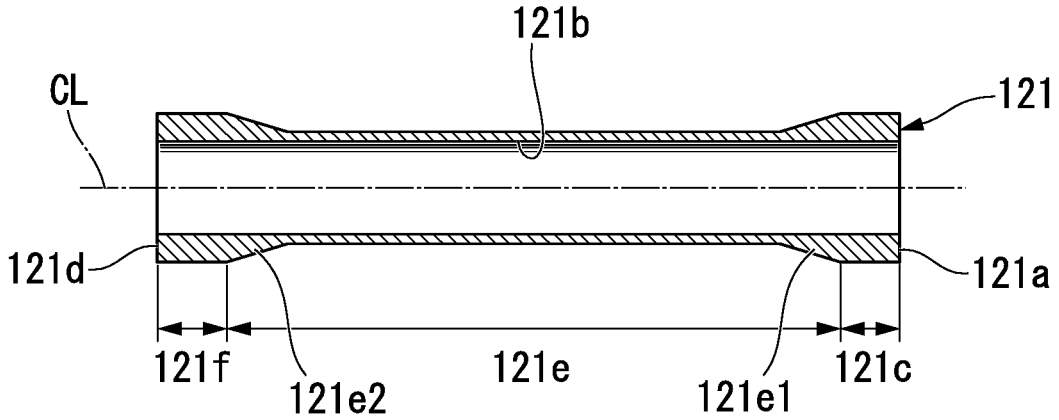
FIG. 12 is a view showing another example of a variable wall thickness steel pipe manufactured by the method of manufacturing a variable wall thickness steel pipe according to the same embodiment and is a cross-sectional view seen in a cross section including the axis of the raw pipe.

FIG. 12 shows another example of a variable wall thickness steel pipe manufactured via the steps shown in FIGS. 10(*a*) to 10(*d*). A variable wall thickness steel pipe 121 shown in FIG. 12 is a variable wall thickness steel pipe manufactured by thrusting the plug 22 until the large-diameter base end portion 22*b* of the plug 22 reaches the one end portion 1*a* of the raw pipe 1, in the step shown in FIG. 10(*d*).

The variable wall thickness steel pipe 121 shown in FIG. 12 is configured to include a diameter-increasing portion 121*c* (1*c*) which is located on one end portion 121*a* side and is increased in diameter from the raw pipe 1, a diameter-increasing portion 121*f* (1*c*) which is located on the other end portion 121*d* (1*d*) side and is increased in diameter from the raw pipe 1, and a middle portion 121*e* (1*e*) which is located between the one end portion 121*a* and the other end portion 121*d* and is subjected to ironing. The middle portion 121*e* also includes a part subjected to working by the tapered portion 12*c* of the die 12 and the tapered portion 21*c* of the plug 21 at a boundary with respect to the diameter-increasing portion 121*c*, and a part subjected to working by the tapered portion 12*e* of the die 12 and the tapered portion 22*c* of the plug 22 at a boundary with respect to the diameter-increasing portion 121*f*. That is, the middle portion 121*e* includes a lock portion 121*e*1 (1*g*1) leading to the diameter-increasing portion 121*c*, and a lock portion 121*e*2 (1*h*1) leading to the diameter-increasing portion 121*f*.

In a hollow portion 121*b* of the variable wall thickness steel pipe 121, the entire inner diameter in its longitudinal direction is further increased than the inner diameter $d_2$ of the raw pipe 1. In addition, the outer diameter of the variable wall thickness steel pipe 121 is further increased than the outer diameter $d_1$ of the raw pipe 1 in the diameter-increasing portion 121*c*, lock portions 121*e*1 and 121*e*2 located at both ends of the middle portion 121*e*, and the diameter-increasing portion 121*f*. Moreover, a part excluding the lock portions 121*e*1 and 121*e*2 from the middle portion 121*e* remains unchanged as the outer diameter $d_1$ of the raw pipe 1. Accordingly, the variable wall thickness steel pipe 121 has a comparatively great thickness in the diameter-increasing portion 121*c* and the diameter-increasing portion 121*f* and has a comparatively small thickness in the middle portion 41*e*.

In the variable wall thickness steel pipe 121 shown in FIG. 12, since a small working amount is applied to the diameter-increasing portion 121*c* and the diameter-increasing portion 121*f*, no work hardening has occurred in these part, or even if work hardening has occurred, it is very insignificant. Therefore, even in a case where post-working such as bending is performed with respect to the diameter-increasing portion 121*c* or the diameter-increasing portion 121*f*, annealing treatment or the like for softening work hardening becomes unnecessary.

In addition, since a comparatively large working amount is applied to the middle portion 121*e*, the middle portion 121*e* has comparatively high strength due to work hardening.

As described above, in the embodiment shown in FIGS. 10(*a*) to 11, the variable wall thickness steel pipe 111 is manufactured by using one die 12 and two plugs 21 and 22. Therefore, the diameter-increasing portion 1*c* (121*c*) and the diameter-increasing portion 1*f* (121*f*) can be respectively provided on the one end portion 1*a* side and the other end portion 1*d* side of the raw pipe 1. In addition, a region which remains unprocessed as the raw pipe 1 and regions subjected to ironing on both sides in the longitudinal direction can be provided in a region between the diameter-increasing portion 1*c* and the diameter-increasing portion 1*f* of the raw pipe 1, so that it is possible to manufacture a variable wall thickness steel pipe in which the thickness varies in stages.

In the fifth embodiment described above, the variable wall thickness steel pipe 111 is manufactured by using the die 12 in a line symmetric shape having the one-dot chained line in FIGS. 10(*a*) to 10(*d*) as a symmetric axis. However, the die 12 may have a non-line symmetric shape, and the variable wall thickness steel pipe 111 may be manufactured by using two plugs of which the shapes are different from each other.

Sixth Embodiment

Next, a method of manufacturing a variable wall thickness steel pipe of a sixth embodiment will be described with reference to FIGS. 13(*a*) to 13(*c*). The method of manufacturing a variable wall thickness steel pipe of the present embodiment is configured to include a step similar to that of the first embodiment. In the present embodiment, the variable wall thickness steel pipe is manufactured by using a die 13 which is different from the die 11 used in the first embodiment. Since other configurations are similar to those of the first embodiment, a description will be omitted.

Figure 13:
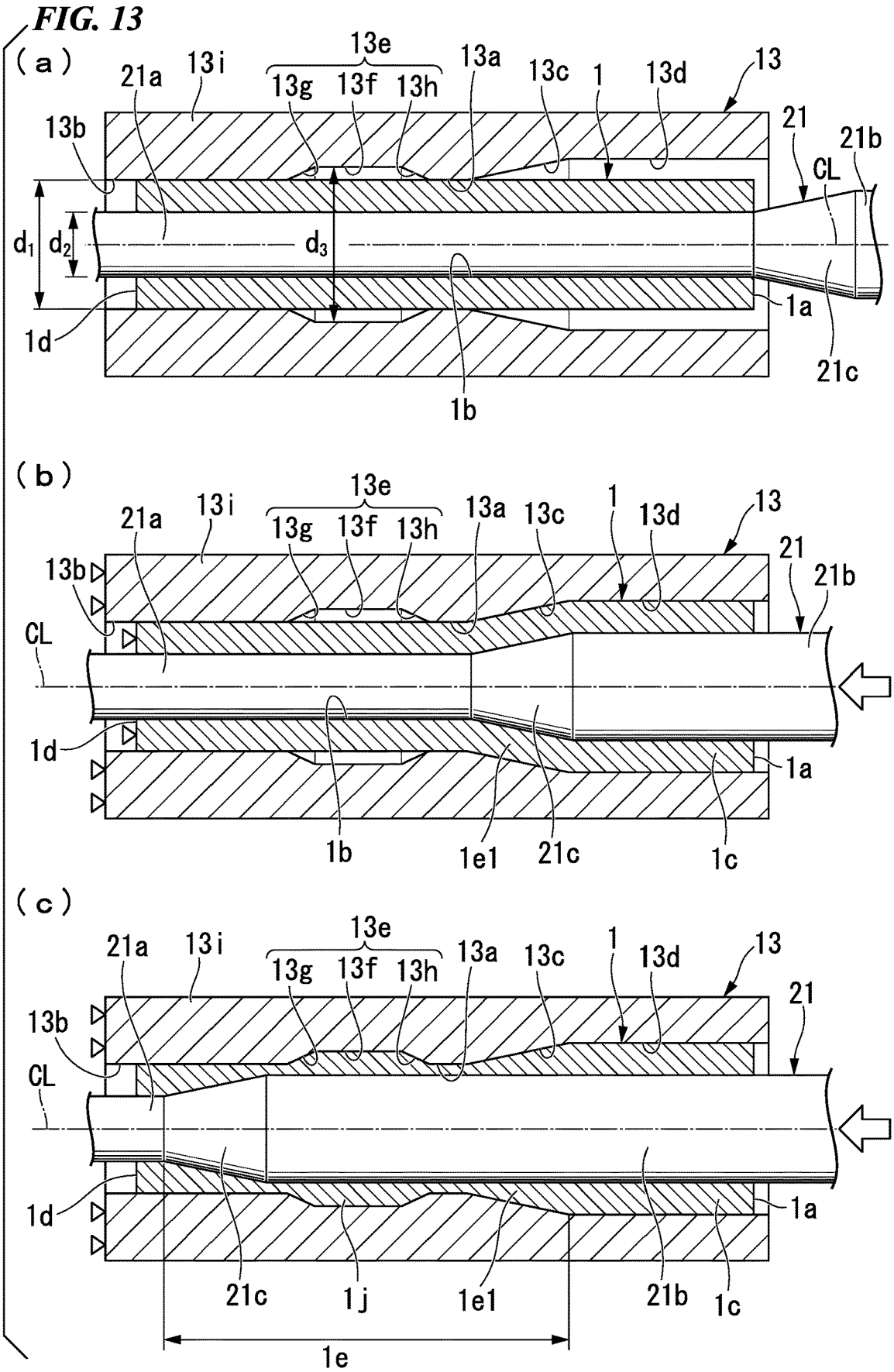
FIG. 13 is a process drawing showing a method of manufacturing a variable wall thickness steel pipe according to a sixth embodiment of the present invention and is a cross-sectional view seen in a cross section including an axis of a raw pipe.

As shown in FIG. 13(*a*), the die 13 used in the present embodiment is configured to include a first hollow small-diameter portion 13*a* and a second hollow small-diameter portion 13*b* having an inner diameter corresponding to the outer diameter $d_1$ of the raw pipe 1, a thickly-formed portion 13*e* being provided between the first hollow small-diameter portion 13*a* and the second hollow small-diameter portion 13*b*, a hollow large-diameter portion 13*d* having an inner diameter $d_3$ larger than the outer diameter $d_1$ of the raw pipe 1, and a tapered portion 13*c* being provided between the first hollow small-diameter portion 13*a* and the hollow large-diameter portion 13*d*. The hollow large-diameter portion 13*d*, the tapered portion 13*c*, the first hollow small-diameter portion 13*a*, the thickly-formed portion 13*e*, and the second hollow small-diameter portion 13*b* communicate with each other inside a die main body 13*i*. In addition, the die 13 can be divided in the upward/downward direction on the sheet in FIG. 13(*a*).

The thickly-formed portion 13*e* is configured to include a hollow intermediate-diameter portion 13*f*, a tapered portion 13*h* being provided between the hollow intermediate-diameter portion 13*f* and the first hollow small-diameter portion 13*a*, and a tapered portion 13*g* being provided between the hollow intermediate-diameter portion 13*f* and the second hollow small-diameter portion 13*b*. The inner diameter $d_3$ of the hollow intermediate-diameter portion 13*f* is set to be an inner diameter larger than the outer diameter $d_1$ of the raw pipe 1 and to be an inner diameter smaller than the inner diameter of the hollow large-diameter portion 13*d*. If the inner diameter $d_3$ of the hollow intermediate-diameter portion 13*f* is larger than the inner diameter of the hollow large-diameter portion 13*d*, the raw pipe 1 is only subjected to pipe expanding in the hollow intermediate-diameter portion 13*f* during the ironing step without being subjected to thinning. Therefore, the thickness of the raw pipe 1 in the thickly-formed portion 13*e* remains unchanged as the original thickness of the raw pipe 1.

Next, similar to the first embodiment, as shown in FIG. 13(*b*), the diameter-increasing step is performed. First, while the end portions of the die 13 and the raw pipe 1 on the sheet left side are in a fixed state, the small-diameter tip end portion 21*a* and the large-diameter base end portion 21*b* of the plug 21 are thrust into the one end portion 1*a* of the raw pipe 1. The plug 21 is thrust until the tapered portion 21*c* reaches the position of the tapered portion 13*c* of the die 13. Accordingly, the diameter-increasing portion 1*c* and the lock portion 1*e*1 are formed in the one end portion 1*a* of the raw pipe 1.

Next, as shown in FIG. 13(*c*), as the ironing step, in a state where the fixed state of the raw pipe 1 is released, whereas the fixed state of the die 13 is maintained, the plug 21 is further thrust toward the other end portion 1*d* side of the raw pipe 1. As the plug 21 is further thrust, the raw pipe 1 is pushed from the one end portion 1*a* toward the other end portion 1*d* side. However, since the lock portion 1*e*1 formed in the raw pipe 1 in the previous step remains locked in the tapered portion 13*c* of the die 13, the raw pipe 1 does not move. If the tapered portion 21*c* and the large-diameter base end portion 21*b* of the plug 21 are thrust to the position shown in FIG. 13(*c*), since the inner diameter $d_3$ of the hollow intermediate-diameter portion 13*f* of the die 13 is larger than the outer diameter $d_1$ of the raw pipe 1, the thickness portion of the raw pipe 1 flows into the thickly-formed portion 13*e*. Accordingly, a thick portion 1*j* is formed in the raw pipe 1.

Figure 14:
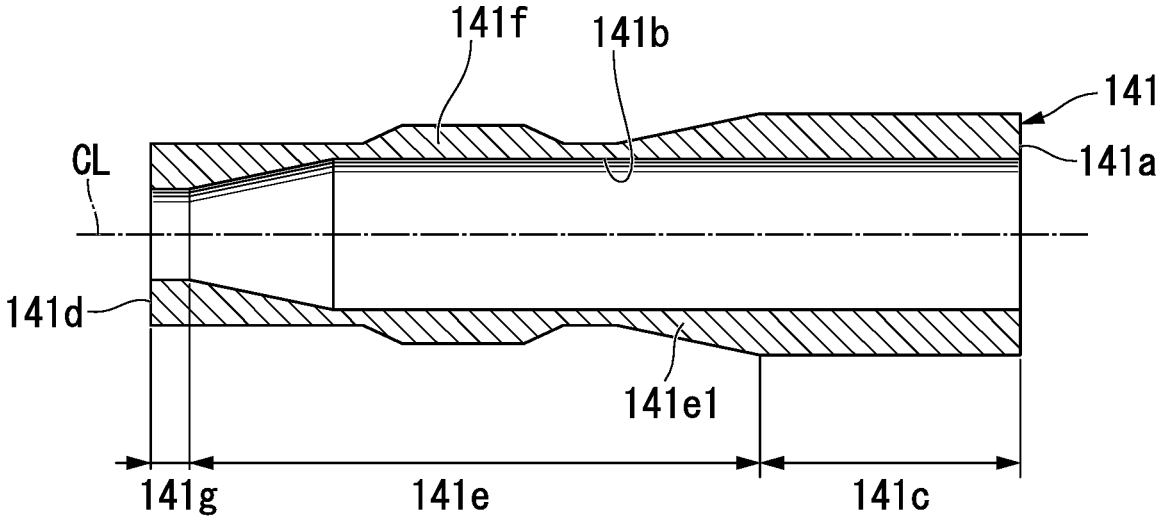
FIG. 14 is a view showing an example of a variable wall thickness steel pipe manufactured by the method of manufacturing a variable wall thickness steel pipe according to the same embodiment and is a cross-sectional view seen in a cross section including the axis of the raw pipe.

FIG. 14 shows a schematic cross-sectional view of a variable wall thickness steel pipe 141 manufactured via the steps shown in FIGS. 13(*a*) to 13(*c*). The variable wall thickness steel pipe 141 is configured to include a diameter-increasing portion 141*c* (1*c*) which is located on one end portion 141*a* (1*a*) side and is increased in diameter from the raw pipe 1, a middle portion 141*e* (1*e*) which is located between the one end portion 141*a* and the other end portion 141*d* (1*d*) and is subjected to ironing, and an unprocessed portion 141*g* which is located on the other end portion 141*d* side of the middle portion 141*e* and remains unprocessed as the raw pipe 1. The middle portion 141*e* also includes a lock portion 141*e*1 (1*e*1) subjected to working by the tapered portion 13*c* of the die 13 and the tapered portion 21*c* of the plug 21 at a boundary with respect to the diameter-increasing portion 141*c*, and a thick portion 141*f* subjected to working by the thickly-formed portion 13*e* of the die 13 and the tapered portion 21*c* of the plug 21.

A hollow portion 141*b* of the variable wall thickness steel pipe 141 remains unchanged as the inner diameter $d_2$ of the raw pipe 1 in the unprocessed portion 141*g*, whereas a hollow portion 141*b* of the variable wall thickness steel pipe 141 is further increased in diameter than the inner diameter $d_2$ of the raw pipe 1 in the diameter-increasing portion 141*c* and the middle portion 141*e*. In addition, in the diameter-increasing portion 141$c$, a lock portion 141$e$1, and the thick portion 141$f$, the outer diameter of the variable wall thickness steel pipe 141 is further increased than the outer diameter $d_1$ of the raw pipe 1. In a part other than the thick portion 141$f$ and the lock portion 141$e$1 in the middle portion 141$e$, and the unprocessed portion 141$g$, the outer diameter $d_1$ of the raw pipe 1 remains unchanged. Therefore, in a case of being seen in the longitudinal direction, the variable wall thickness steel pipe 141 has a constant inner diameter in the shape-increasing portion 141$g$ and a part of the middle portion 141$e$ excluding a portion thereof. Furthermore, the thick portion 141$f$ and the diameter-increasing portion 141$c$ have outer diameters different from each other.

In the variable wall thickness steel pipe 141 shown in FIG. 14, since a small working amount is applied to the diameter-increasing portion 141$c$ and the unprocessed portion 141$g$, no work hardening has occurred in these parts, or even if work hardening has occurred, it is very insignificant. Therefore, the diameter-increasing portion 141$c$ and the unprocessed portion 141$g$ have low strength. Accordingly, even in a case where post-working such as bending is performed with respect to these parts, annealing treatment or the like for softening work hardening becomes unnecessary.

In addition, since a comparatively large working amount is applied to the middle portion 141$e$ of the variable wall thickness steel pipe 141, the middle portion 141$e$ has comparatively high strength due to work hardening.

Figure 15:
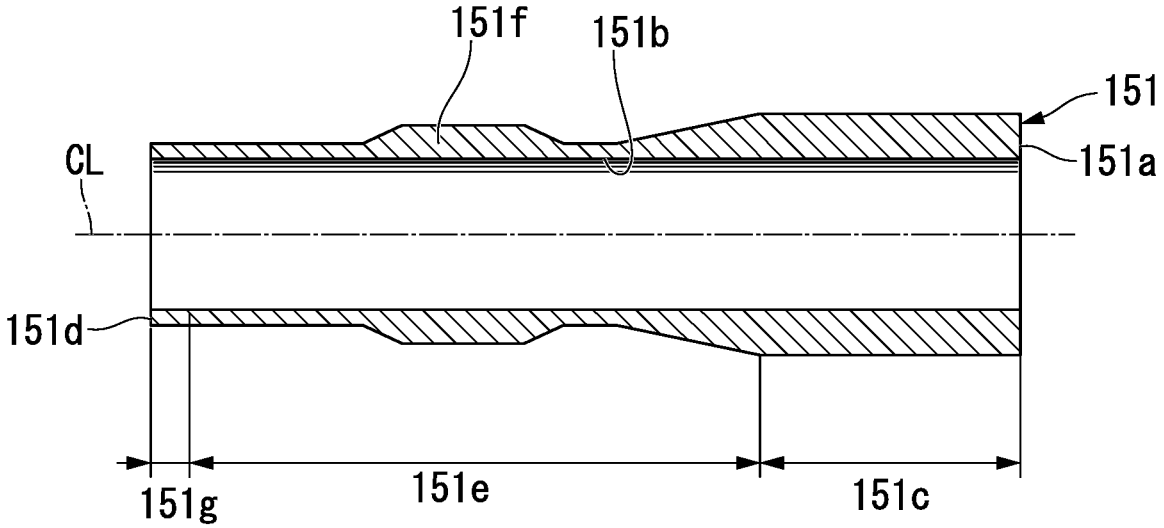
FIG. 15 is a view showing another example of a variable wall thickness steel pipe manufactured by the method of manufacturing a variable wall thickness steel pipe according to the same embodiment and is a cross-sectional view seen in a cross section including the axis of the raw pipe.

FIG. 15 shows another example of a variable wall thickness steel pipe manufactured via the steps shown in FIGS. 13($a$) to 13($c$). That is, in this example, in the step shown in FIG. 13($c$), a variable wall thickness steel pipe 151 having a shape as shown in FIG. 15 is worked by thrusting the plug 21 until the large-diameter base end portion 21$b$ of the plug 21 reaches the other end portion 1$d$ of the raw pipe 1.

The variable wall thickness steel pipe 151 shown in FIG. 15 is configured to include a diameter-increasing portion 151$c$ (1$c$) which is located on one end portion 151$a$ (1$a$) side and is increased in diameter from the raw pipe 1, a middle portion 151$e$ (1$e$) which is located between the one end portion 151$a$ and the other end portion 151$d$ (1$d$) and is subjected to ironing, and the other end part 151$g$ which is located on the other end portion 151$d$ side of the middle portion 151$e$ and is subjected to ironing, similar to the middle portion 151$e$. The middle portion 151$e$ includes a part subjected to working by the tapered portion 13$c$ of the die 13 and the tapered portion 21$c$ of the plug 21 at a boundary with respect to the diameter-increasing portion 151$c$, and a thick portion 151$f$ subjected to working by the thickly-formed portion 13$e$ of the die 13 and the tapered portion 21$c$ of the plug 21.

In a hollow portion 151$b$ of the variable wall thickness steel pipe 151, the entire inner diameter in its longitudinal direction is further increased than the inner diameter $d_2$ of the raw pipe 1. In addition, the outer diameter of the variable wall thickness steel pipe 151 is further increased than the outer diameter $d_1$ of the raw pipe 1 in the diameter-increasing portion 151$c$ and the thick portion 151$f$. In the middle portion 151$e$ and the other end part 151$g$ other than the thick portion 151$f$, the outer diameter $d_1$ of the raw pipe 1 remains unchanged. Therefore, the variable wall thickness steel pipe 151 has an entirely constant inner diameter in the longitudinal direction and has a plurality of parts of which the outer diameters are different from each other.

In the variable wall thickness steel pipe 151 shown in FIG. 15, since a small working amount is applied to the diameter-increasing portion 151$c$, no work hardening has occurred in this part, or even if work hardening has occurred, it is very insignificant. Therefore, the diameter-increasing portion 151$c$ has comparatively low strength. Accordingly, even in a case where post-working such as bending is performed with respect to this part, annealing treatment or the like for softening work hardening becomes unnecessary.

In addition, since a comparatively large working amount is applied to the middle portion 151$e$ and the other end part 151$g$ of the variable wall thickness steel pipe 151, the middle portion 151$e$ and the other end part 151$g$ have comparatively high strength due to work hardening.

As described above, in the embodiment shown in FIGS. 13($a$) to 14, the variable wall thickness steel pipe 141 is manufactured by using the die 13 having the thickly-formed portion 13$e$ between the first hollow small-diameter portion 13$a$ and the second hollow small-diameter portion 13$b$. Therefore, it is possible to manufacture the variable wall thickness steel pipe 141 having the thick portion 1$j$ (141$f$) in the middle portion 1$e$ of the raw pipe 1 (141$e$). In addition, it is possible to manufacture the variable wall thickness steel pipe 141 of which outer diameters are different from each other in the thick portion 1$j$ and the diameter-increasing portion 1$c$ (141$c$).

In addition, in the variable wall thickness steel pipe 141, since the working amount is comparatively small on the other end portion 1$d$ (141$d$) side of the diameter-increasing portion 1$c$ and the middle portion 1$e$, strength is low. Meanwhile, in the middle portion 1$e$ including the thick portion 1$j$, since the working amount is comparatively large, strength is high.

Seventh Embodiment

Next, a method of manufacturing a variable wall thickness steel pipe of a seventh embodiment will be described with reference to FIGS. 16($a$) to 16($c$). The method of manufacturing a variable wall thickness steel pipe of the present embodiment is configured to include a step similar to that of the first embodiment. In the present embodiment, the variable wall thickness steel pipe is manufactured by using a plug 161 which is different from the plug 21 used in the first embodiment. Since other configurations are similar to those of the first embodiment, a description will be omitted.

Figure 16:
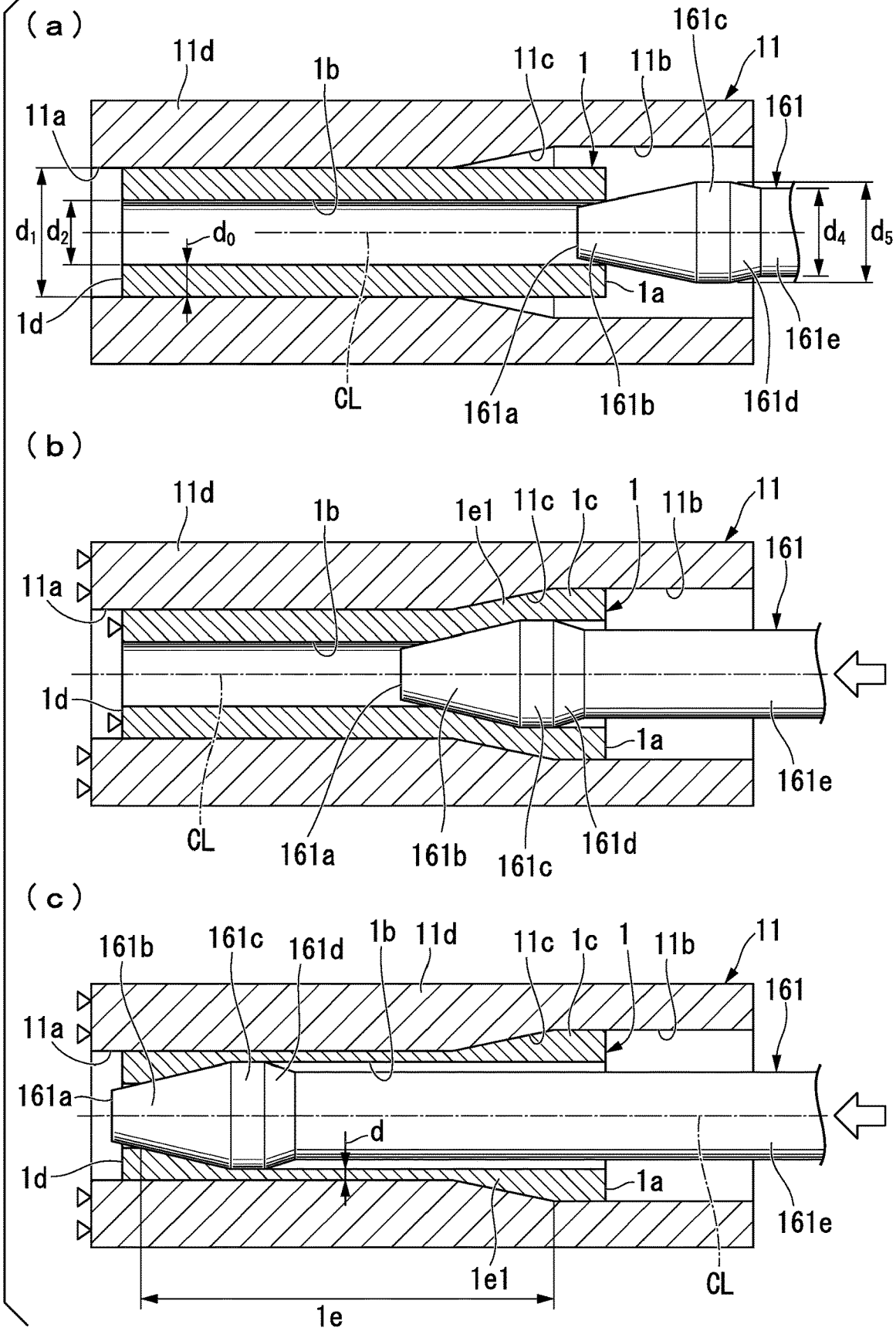
FIG. 16 is a process drawing showing a method of manufacturing a variable wall thickness steel pipe according to a seventh embodiment of the present invention and is a cross-sectional view seen in a cross section including an axis of a raw pipe.

As shown in FIG. 16($a$), the plug 161 used in the present embodiment is configured to include a tapered tip end portion 161$b$ having a tip end portion 161$a$ having an outer diameter smaller than the inner diameter $d_2$ of the raw pipe 1, a large-diameter portion 161$c$ having a diameter $d_5$ larger than the inner diameter $d_2$ of the raw pipe 1 and smaller than the inner diameter $d_1$ of the hollow small-diameter portion 11$a$ of the die 11, and a small-diameter base end portion 161$e$ having a diameter $d_4$ smaller than the diameter $d_5$ of the large-diameter portion 161$c$. A tapered portion 161$d$ is provided between the large-diameter portion 161$c$ and the small-diameter base end portion 161$e$.

Similar to the first embodiment, as the diameter-increasing step shown in FIG. 16($b$), while the sheet left sides of the die 11 and the raw pipe 1 are in a fixed state, the tapered tip end portion 161$b$ and the large-diameter portion 161$c$ of the plug 161 are thrust into the one end portion 1$a$ of the raw pipe 1. The plug 161 is thrust until the tapered tip end portion 161$b$ reaches the position of the tapered portion 11$c$ of the die 11. Accordingly, the diameter-increasing portion 1$c$ and the lock portion 1$e$1 are formed in the one end portion 1$a$ of the raw pipe 1.

Next, as the ironing step shown in FIG. 16($c$), in a state where the fixed state of the raw pipe 1 is released, whereas the fixed state of the die 11 is maintained, the plug 161 is further thrust toward the other end portion 1*d* side of the raw pipe 1. As the plug 161 is further thrust, the raw pipe 1 is pushed from the one end portion 1*a* toward the other end portion 1*d* side. However, since the lock portion 1*e*1 formed in the raw pipe 1 in the previous step remains locked in the tapered portion 11*c* of the die 11, the raw pipe 1 does not move.

If the plug 161 is thrust as shown in FIG. 16(*c*), in the middle portion 1*e* of the raw pipe 1 in which the large-diameter portion 161*c* of the plug 161 is thrust, the original inner diameter $d_2$ of the raw pipe 1 is increased to a size corresponding to the diameter $d_5$ of the large-diameter portion 161*c* of the plug 161. At this time, since the diameter $d_4$ of the small-diameter base end portion 161*e* succeeding the large-diameter portion 161*c* of the plug 161 is smaller than the diameter $d_5$ of the large-diameter portion 161*c*, the small-diameter base end portion 161*e* does not come into contact with a part of the raw pipe 1 subjected to ironing. In this manner, in the ironing step, the plug 161 comes into contact with the raw pipe 1 in only the tapered tip end portion 161*b* and the large-diameter portion 161*c*. Accordingly, since a part of the plug 161 coming into contact with the raw pipe 1 is smaller than that of the first embodiment, frictional resistance between the raw pipe 1 and the plug 161 is reduced in the ironing step.

It is preferable that the difference $(d_5-d_4)$ between the diameter $d_4$ of the small-diameter base end portion 161*e* of the plug 161 in FIG. 16(*a*) and the diameter $d_5$ of the large-diameter portion 161*c* ranges as follows. That is, when the thickness of the raw pipe 1 is $d_0$ and the thickness of the middle portion 1*e* after ironing is d, the difference between $d_0$ and d $(d_0-d)$ is defined as the amount $t_d$ of thickness reduction. At this time, the amount $t_d$ of thickness reduction and the difference $(d_5-d_4)$ between the diameter $d_4$ of the small-diameter base end portion 161*e* and the diameter $d_5$ of the large-diameter portion 161*c* is favorable to be $2\times t_d \geq (d_5-d_4)$. If the difference $(d_5-d_4)$ between the diameter $d_5$ of the small-diameter base end portion 161*e* and the diameter $d_4$ of the large-diameter portion 161*c* exceeds $2\times t_d$, depending on the combination of the strength and the amount of thickness reduction of the material, the lock portion 1*e*1 of the raw pipe 1 can no longer be locked in the tapered portion 11*c* of the die 11 in the ironing step shown in FIG. 16(*c*).

A variable wall thickness steel pipe manufactured via the steps shown in FIGS. 16(*a*) to 16(*c*) has a shape similar to the variable wall thickness steel pipe 31 shown in FIG. 2. In addition, in the step shown in FIG. 16(*c*), the variable wall thickness steel pipe may be worked into a shape similar to that of the variable wall thickness steel pipe 41 shown in FIG. 3 by thrusting the plug 161 until the large-diameter portion 161*c* of the plug 161 reaches the other end portion 1*d* of the raw pipe 1.

As described above, in the present embodiment, as a variable wall thickness steel pipe is manufactured by using the plug 161 provided with the small-diameter base end portion 161*e* having a diameter smaller than the diameter of the large-diameter portion 161*c*, the ironing step can be performed without having the small-diameter base end portion 161*e* and a part of the raw pipe 1 subjected to ironing coming into contact with each other in the ironing step. That is, when the plug 161 is thrust, only the tapered tip end portion 161*b* and the large-diameter portion 161*c* come into slide contact with the inner surface of the raw pipe 1. In addition, when the plug 161 is pulled out, only the large-diameter portion 161*c* mainly comes into slide contact with the inner surface of the raw pipe 1. In this manner, when the plug 161 is taken out and put in, since the small-diameter base end portion 161*e* does not come into slide contact with the inner surface of the raw pipe 1, compared to the first embodiment, frictional resistance between the raw pipe 1 and the plug 161 can be reduced when the plug 161 is taken out and put in the ironing step, and a force required for working can be prevented from being excessive.

Eighth Embodiment

A method of manufacturing a variable wall thickness steel pipe of an eighth embodiment has a step of performing drawing after ironing of the first to fourth embodiments and the sixth and seventh embodiments. In the present embodiment, as an example, the variable wall thickness steel pipe 61 manufactured via the step of the second embodiment is taken as an intermediate product 15, and drawing is performed with respect to the intermediate product 15.

First, a die 14 and the intermediate product 15 used in the present embodiment will be described with reference to FIGS. 17(*a*) and 17(*b*). The intermediate product 15 shown in FIG. 17(*a*) is the variable wall thickness steel pipe 61 manufactured via the step of the second embodiment. The intermediate product 15 is configured to include a diameter-increasing portion 15*c* which is located in one end portion 15*a* side and is increased in diameter from the raw pipe 1, a middle portion 15*e* which is located between the one end portion 15*a* and the other end portion 15*d* and is subjected to ironing, and an unprocessed portion 15*f* which is located on the other end portion 15*d* side of the middle portion 15*e* and remains unprocessed as the raw pipe 1. The middle portion 15*e* also includes a part subjected to working by the tapered portion 11*c* of the die 11 used in the second embodiment, and the tapered portions 51*d* and 51*e* of the plug 51 at each of boundaries with respect to the diameter-increasing portion 15*c* and the unprocessed portion 15*f*.

Figure 17:
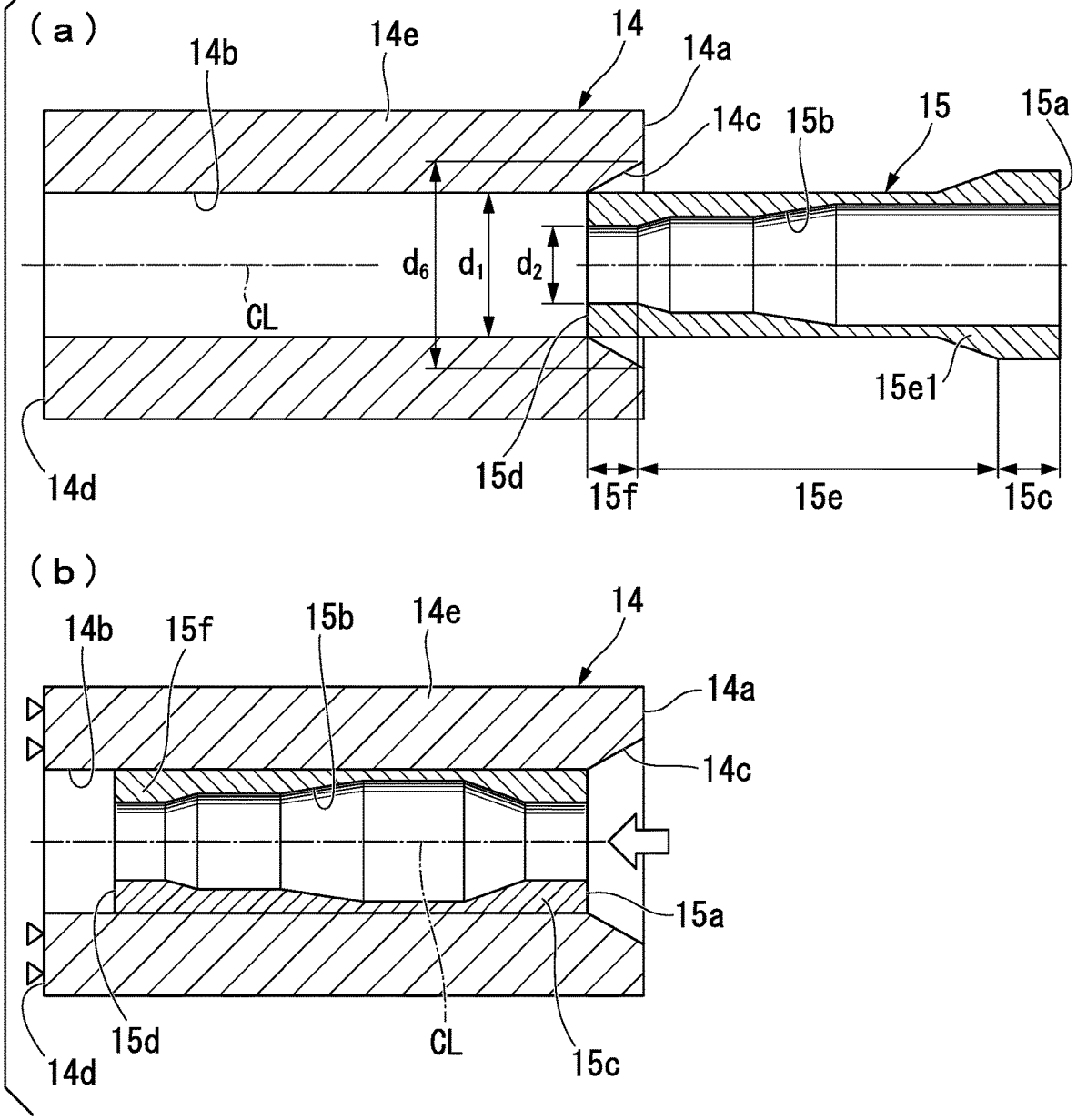
FIG. 17 is a process drawing showing a method of manufacturing a variable wall thickness steel pipe according to an eighth embodiment of the present invention and is a cross-sectional view seen in a cross section including an axis of a raw pipe.

The die 14 shown in FIG. 17(*a*) is configured to include a hollow small-diameter portion 14*b* having an inner diameter corresponding to the outer diameters of the unprocessed portion 15*f* and the middle portion 15*e* of the intermediate product 15, and a tapered portion 14*c* leading to the hollow small-diameter portion 14*b*. The above-mentioned expression "the inner diameter corresponding to the outer diameters of the unprocessed portion 15*f* and the middle portion 15*e*" indicates a diameter size in which a gap size, to the extent that the hollow small-diameter portion 14*b* can be taken out and put in with respect to the inside and the outside, is added to the outer diameters of the unprocessed portion 15*f* and the middle portion 15*e*. In addition, the hollow small-diameter portion 14*b* and the tapered portion 14*c* communicate with each other inside a die main body 14*e*.

Since the outer diameters of the unprocessed portion 15*f* and the middle portion 15*e* of the intermediate product 15 are the same as the outer diameter $d_1$ of the raw pipe 1, the inner diameter of the hollow small-diameter portion 14*b* corresponds to the outer diameter $d_1$ of the raw pipe 1. The inner diameter of the tapered portion 14*c* becomes the largest diameter on one end portion 14*a* side of the die 14, and an inner diameter $d_6$ at this position is set to a size larger than the outer diameter of the diameter-increasing portion 15*c* of the intermediate product 15.

Next, the method of manufacturing a variable wall thickness steel pipe according to the present embodiment will be described. First, the intermediate product 15 is manufactured. Since the method of manufacturing the intermediate product 15 is similar to that of the second embodiment, a description will be omitted.

Next, as shown in FIGS. 17(*a*) and 17(*b*), in a state where the die 14 is fixed, the intermediate product 15 is inserted from the one end portion 14*a* side toward the other end portion 14*d* side of the die 14. If a lock portion 15*e*1 of the intermediate product 15 reaches the position of the tapered portion 14*c* of the die 14, the diameter-increasing portion 15*c* is locked in the tapered portion 14*c*. However, the intermediate product 15 is further thrust to the other end portion 14*d* side. Then, the lock portion 15*e*1 and the diameter-increasing portion 15*c* are pressed by the tapered portion 14*c*, so that the outer surfaces of the lock portion 15*e*1 and the diameter-increasing portion 15*c* are pressurized, and drawing is performed with respect to the lock portion 15*e*1 and the diameter-increasing portion 15*c* such that the outer diameters thereof are drawn.

If the intermediate product 15 is thrust to the position shown in FIG. 17(*b*), drawing is performed with respect to the lock portion 15*e*1 and the diameter-increasing portion 15*c* in their entirety. Therefore, the entire outer diameter of the intermediate product 15 in the longitudinal direction becomes the same outer diameter as the inner diameter $d_1$ of the hollow small-diameter portion 14*b* of the die 14.

Figure 18:
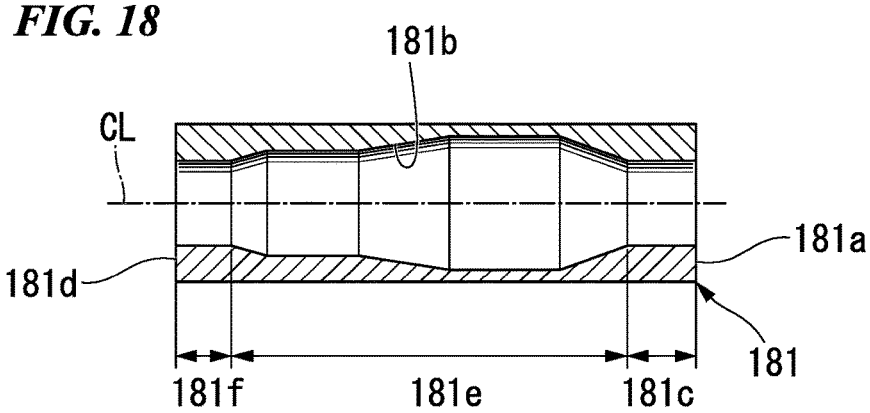
FIG. 18 is a view showing a variable wall thickness steel pipe manufactured by the method of manufacturing a variable wall thickness steel pipe of the same embodiment and is a cross-sectional view seen in a cross section including the axis of the raw pipe.

FIG. 18 shows a schematic cross-sectional view of a variable wall thickness steel pipe 181 manufactured in accordance with the present embodiment. The variable wall thickness steel pipe 181 includes a diameter-reducing portion 181*c* which is located on one end portion 181*a* (15*a*) side and in which the diameter-increasing portion 15*c* of the intermediate product 15 is subjected to drawing, and a part corresponding to the lock portion 15*e*1 which is subjected to drawing in the same manner. Meanwhile, other parts of the variable wall thickness steel pipe 181 are configured to include a middle portion 181*e* (15*e*) which is not subjected to drawing and remains unchanged as the intermediate product 15, and an unprocessed portion 181*f* (15*f*) which is not subjected to drawing and remains unchanged as the intermediate product 15.

In a hollow portion 181*b* of the variable wall thickness steel pipe 181, the entire outer diameter in its the longitudinal direction remains unchanged as the outer diameter of the raw pipe 1. In addition, in the diameter-reducing portion 181*c* and the unprocessed portion 181*f*, the inner diameter of the variable wall thickness steel pipe 181 remains unchanged as the inner diameter $d_2$ of the raw pipe 1. In the middle portion 181*e*, the inner diameter thereof is further increased than the inner diameter $d_2$ of the raw pipe 1. Therefore, the variable wall thickness steel pipe 181 has an entirely constant outer diameter in the longitudinal direction and has a plurality of regions of which the inner diameters are different from each other at positions in the longitudinal direction.

The variable wall thickness steel pipe 181 has a comparatively great thickness in the diameter-reducing portion 181*c* and the unprocessed portion 181*f* and has a comparatively small thickness in the middle portion 181*e*.

In addition, in the variable wall thickness steel pipe 181, since a small working amount is applied to the unprocessed portion 181*f*, no work hardening has occurred in this part, or even if work hardening has occurred, it is very insignificant. Therefore, the unprocessed portion 181*f* has comparatively low strength. Accordingly, even in a case where post-working such as bending is performed with respect to this part, annealing treatment or the like for softening work hardening becomes unnecessary.

In the present embodiment, as an example of the intermediate product 15, the variable wall thickness steel pipe 61 manufactured in accordance with the second embodiment is employed. However, the present embodiment is not limited to only this example. For example, an intermediate product of the present embodiment may be the variable wall thickness steel pipe 31 which is manufactured in accordance with the first embodiment as shown in FIG. 2.

In addition, So that drawing is performed with respect to the entire outer surface of the intermediate product 15, the inner diameter of the hollow small-diameter portion 14*b* of the die 14 used in the present embodiment may be an inner diameter smaller than the outer diameter of the raw pipe 1. In this case, if the inner diameter of the hollow small-diameter portion 14*b* of the die 14 is excessively small with respect to the outer diameter of the raw pipe 1, an opening drawing rate becomes excessively significant, so that there is concern that buckling may occur at the time of drawing. The opening drawing rate in this case will be described below.

Generally, as steel pipes for automobiles, steel pipes of which a ratio of the steel pipe thickness to the steel pipe outer diameter ($t/D_0$, t: thickness of raw pipe and $D_0$: outer diameter of raw pipe) ranges from 0.001 to 0.15 are used. The inventors have minutely investigated the opening drawing rate in a case where drawing is performed with respect to a steel pipe having this size. As a result, it is ascertained that the opening drawing rate is favorably 0.4 or lower. Therefore, in a case where drawing is performed with respect to the entire outer surface of the intermediate product 15, it is favorable that the inner diameter of the hollow small-diameter portion 14*b* of the die 14 is set such that the opening drawing rate becomes 0.4 or lower. The opening drawing rate is expressed by the following Expression (1). The factor κ in the following Expression (1) indicates an opening drawing rate, the factor $D_0$ indicates an outer diameter of a steel pipe before drawing, and the factor D indicates the outer diameter of the steel pipe after drawing.

$$K=(D_0-D)/D_0 \quad (1)$$

As described above, in the present embodiment, it is possible to manufacture the variable wall thickness steel pipe 181 having an entirely constant outer diameter of the raw pipe 1 in the longitudinal direction and having a plurality of regions of which the inner diameters are different from each other. In this variable wall thickness steel pipe 181, since a comparatively small working amount is applied to the unprocessed portion 181*f*, strength in this region is comparatively low. In addition, since a comparatively large working amount is applied to the diameter-reducing portion 181*c* and the middle portion 181*e*, strength in these regions is comparatively high.

In addition, it is possible to manufacture a variable wall thickness steel pipe in which working is performed with respect to the entire region in the longitudinal direction, by performing drawing with respect to the entire outer surface of the intermediate product 15 in the longitudinal direction. In addition, it is possible to manufacture a variable wall thickness steel pipe having an entirely constant outer diameter in the longitudinal direction and having a plurality of regions of which the inner diameters are different from each other. In this variable wall thickness steel pipe, since working is performed with respect to the entire region of the raw pipe 1 in the longitudinal direction, the strength of the entire region is higher than the original strength of the raw pipe 1.

Ninth Embodiment

A ninth embodiment will be described. A method of manufacturing a variable wall thickness steel pipe of the present embodiment is configured to include a step similar to that of the first embodiment. In the present embodiment, the variable wall thickness steel pipe is manufactured by using a plug different from the plug 21 used in the first embodiment and the die 11 used in the first embodiment. Alternatively, the variable wall thickness steel pipe is manufactured by using a die different from the die 11 used in the first embodiment and the plug 21 used in the first embodiment. Since other configurations are similar to those of the first embodiment, a description will be omitted. Hereinafter, as an example of the ninth embodiment, the method of manufacturing a variable wall thickness steel pipe, in which a plug different from the plug 21 used in the first embodiment and the die 11 used in the first embodiment are used, will be described.

Figure 19:
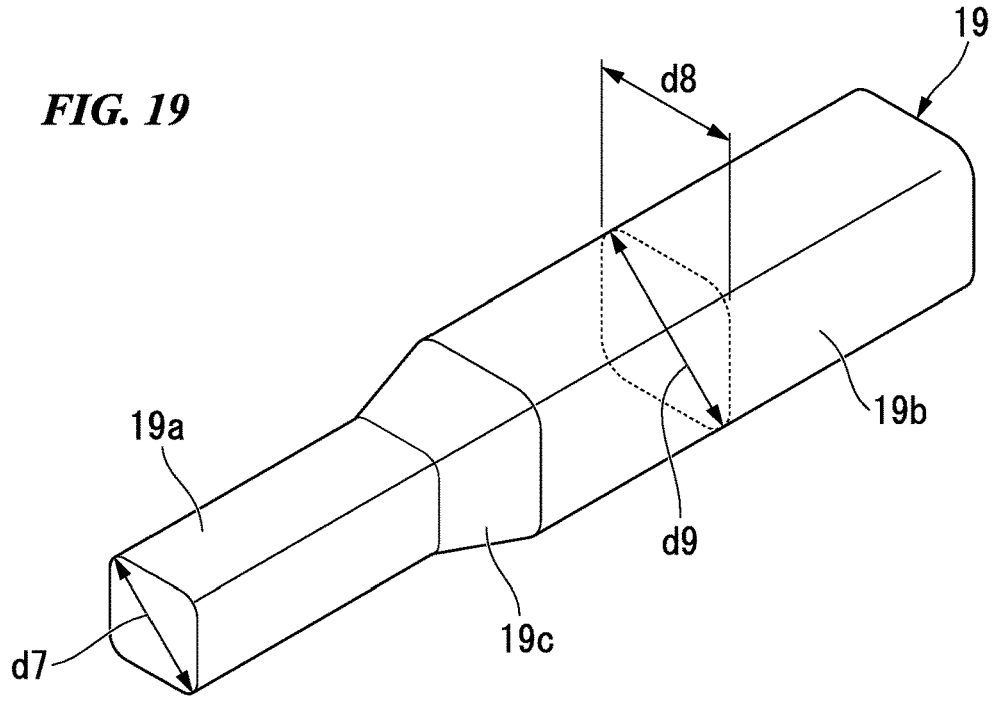
FIG. 19 is a schematic perspective view of a plug used in a method of manufacturing a variable wall thickness steel pipe according to a ninth embodiment of the present invention.

A plug 19 shown in FIG. 19 has a shape different from that of the plug 21 shown in FIG. 1(*a*). The shape of a cross section orthogonal to the longitudinal direction of the plug 19 is a quadrangular shape with rounded corners in its entirety in the longitudinal direction. In addition, the plug 19 is configured to include a small-sized tip end portion 19*a*, a large-sized base end portion 19*b*, and a tapered portion 19*c* provided between the small-sized tip end portion 19*a* and the large-sized base end portion 19*b*.

A diagonal length d7 of a cross section orthogonal to the longitudinal direction in the small-sized tip end portion 19*a* is a diameter corresponding to the inner diameter $d_2$ of the raw pipe 1. In a cross section orthogonal to the longitudinal direction in the large-sized base end portion 19*b*, a side length d8 of the quadrangular shape with rounded corners corresponds to the inner diameter $d_2$ of the raw pipe 1, and a diagonal length d9 is greater than the inner diameter $d_2$ of the raw pipe 1 and is smaller than the inner diameter $d_1$ of the hollow small-diameter portion 11*a* of the die 11.

Figure 20:
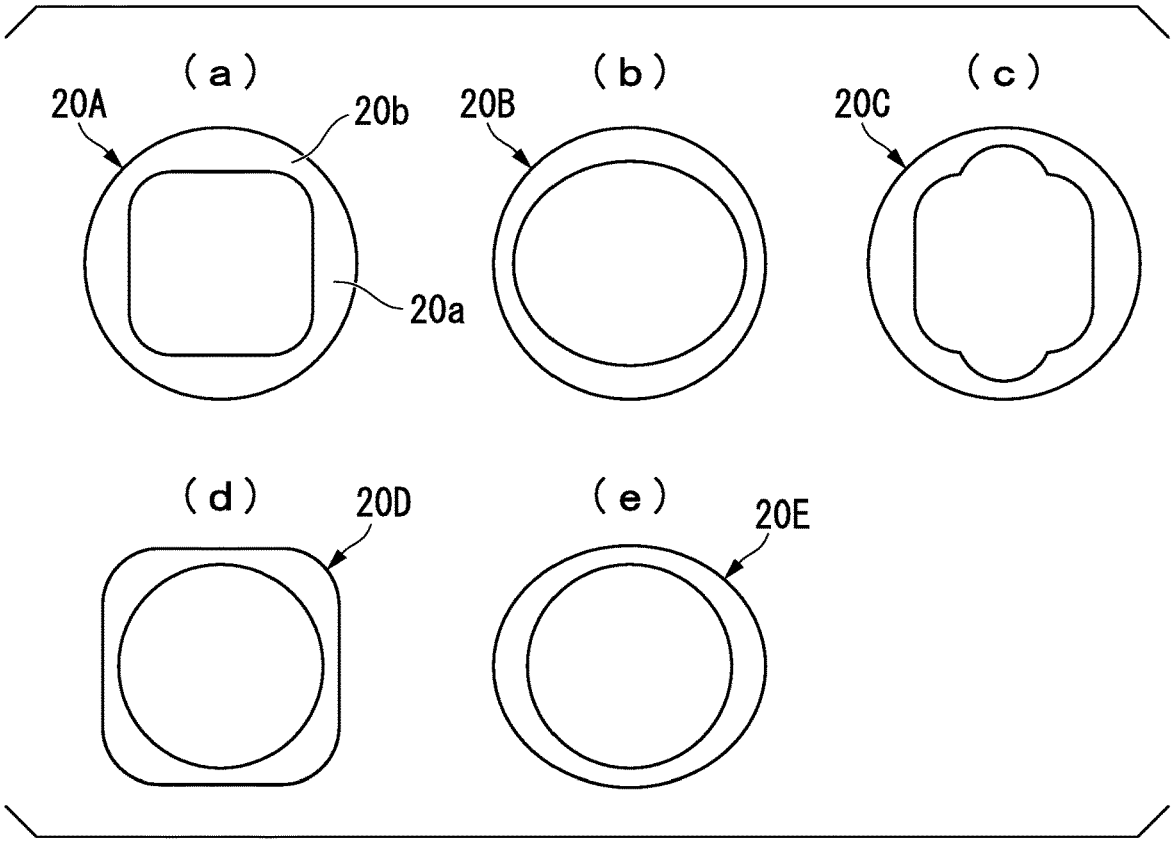
FIG. 20 is a view showing examples of variable wall thickness steel pipes manufactured by the same embodiment and is a cross-sectional view in which a middle portion is seen in a cross section orthogonal to its longitudinal direction.

If a variable wall thickness steel pipe is manufactured through a step similar to that of the first embodiment using the plug 19, a schematic view of a cross section orthogonal to the longitudinal direction in a middle portion subjected to ironing exhibits a shape as shown in FIG. 20(*a*). In the large-sized base end portion 19*b* of the plug 19, since the side length d8 corresponds to the inner diameter $d_2$ of the raw pipe 1 and the long diameter d9 is larger than the inner diameter $d_2$ of the raw pipe 1, a middle portion of a variable wall thickness steel pipe 20A manufactured by the plug 19 has an unprocessed portion 20*a* which remains unprocessed as the raw pipe 1, and a processed portion 20*b*, which has been subjected to ironing. Since the thickness of the unprocessed portion 20*a* remains unchanged as the raw pipe 1 and the working amount is small, strength thereof is comparatively low. Meanwhile, since the thickness of the processed portion 20*b* is comparatively small and the working amount is large, strength thereof is comparatively high. Therefore, in the middle portion subjected to ironing, the variable wall thickness steel pipe 20A manufactured in accordance with the present embodiment alternately has parts which are subjected to ironing and parts which remain unprocessed in the circumferential direction.

In the ninth embodiment described above, the variable wall thickness steel pipe 20A is manufactured through a step similar to the first embodiment using the plug 19 of which the shape of a cross section orthogonal to the longitudinal direction is a quadrangular shape with rounded corners, and the die 11. However, a plug having a different shape of a cross section orthogonal to the longitudinal direction may be used. However, it is favorable that a cross section orthogonal to the longitudinal direction of the plug has a rotationally symmetric shape. The reason is that in a case where a cross section orthogonal to the longitudinal direction of the plug does not have a rotationally symmetric shape, the diameter-increasing portion cannot be sufficiently formed by performing pipe expanding and the raw pipe 1 cannot be locked in the tapered portion 11*c* of the die 11.

FIGS. 20(*b*) and 20(*c*) are views showing cross sections orthogonal to the longitudinal direction in middle portions of variable wall thickness steel pipes 20B and 20C manufactured by using different plugs of which cross sections orthogonal to the longitudinal direction in the eighth embodiment have a rotationally symmetric shape.

As described above, in the present embodiment, the variable wall thickness steel pipe may be manufactured by using a die different from the die 11 used in the first embodiment and the plug 21 used in the first embodiment. It is favorable that the die used in this case has a rotationally symmetric shape of a cross section orthogonal to the longitudinal direction of the die such that pipe expanding can be sufficiently performed. In addition, the outer shape of the raw pipe 1 has to be a shape corresponding to the die.

For example, if a variable wall thickness steel pipe 20D is manufactured by using a square-shaped steel pipe, a die having a shape corresponding to the square-shaped steel pipe, and the plug 21 similar to that of the first embodiment in a manner similar to that of the first embodiment, the shape of a cross section orthogonal to the longitudinal direction in the middle portion of the variable wall thickness steel pipe 20D becomes a shape as shown in FIG. 20(*d*).

FIG. 20(*e*) is a schematic cross-sectional view of the middle portion of a variable wall thickness steel pipe 20E in which the outer shape of a cross section of a raw pipe is an elliptic shape, and a die corresponding to the shape of and the raw pipe, and the plug 21 are used, and which is manufactured by a method similar to that of the first embodiment. In this case as well, the variable wall thickness steel pipe 20E alternately has parts which are subjected to ironing and parts which remain unprocessed in the circumferential direction.

As described above, according to the ninth embodiment, it is possible to manufacture the variable wall thickness steel pipe 20A alternately having parts which are subjected to ironing and parts which remain unprocessed in the circumferential direction, in a middle portion subjected to ironing. In addition, in the variable wall thickness steel pipe 20A, since the thickness of the parts subjected to ironing is small and the working amount is large, strength thereof is comparatively significant. Meanwhile, since the thickness of the parts which remain unprocessed is large and the working amount is small, strength thereof is comparatively small.

As described above, in the method of manufacturing a variable wall thickness steel pipe according to each of the embodiments of the present invention, the lock portion is provided by performing pipe expanding with respect to the raw pipe, and ironing is performed with respect to the middle portion on the other end side of the diameter-increasing portion of the raw pipe such that the inner diameter of the raw pipe is increased while the outer diameter is maintained, by thrusting the plug into the raw pipe while the lock portion is locked in the die. Therefore, the working amount with respect to the diameter-increasing portion can be reduced, so that heat treatment such as annealing can be made unnecessary when post-working such as bending is performed with respect to the diameter-increasing portion.

In addition, since ironing is performed by thrusting the plug into the raw pipe while the lock portion is locked in the die, ironing can be carried out by only relatively moving the die and the plug without fixing the raw pipe itself at the time of ironing.

In addition, it is possible to form parts having a small thickness and comparatively high strength and parts having a large thickness and comparatively low strength in the longitudinal direction of the variable wall thickness steel pipe. Therefore, heat treatment such as annealing can be made unnecessary when post-working such as bending is performed with respect to a part having a large thickness and comparatively small strength.

Application examples of the variable wall thickness steel pipe in each of the embodiments of the present invention for automobile components include a frame member such as a cross-member, a suspension member, and a suspension arm; a collision countermeasure component such as a perimeter and a side impact bar; and a drive system pipe component such as a drive shaft.

In the frame member such as a cross-member, a suspension arm, and a suspension member, there are many cases where a large thickness is particularly required in attachment parts for other components. Therefore, by using the variable wall thickness steel pipe in each of the embodiments of the present invention it is possible to employ a light-weight structure in which only a required location is thickened. In addition, in these components, there are cases where pressing or bending is performed when performing post-working in which the thick portion is formed into a predetermined shape. In these cases, if a part to be subjected to working has a large thickness and low strength, it is easy to perform working. Therefore, it is possible to preferably use the variable wall thickness steel pipe in each of the embodiments of the present invention.

A side impact bar is a member which is installed inside a door panel and transmits collision energy at the time of a collision to both sides of a door, and it is desired that the side impact bar does not break at the time of a collision. Therefore, if a central portion is thickened by using the variable wall thickness steel pipe in each of the embodiments of the present invention, it is possible to realize a light-weight structure.

A perimeter is a frame member in the front part of a vehicle body, and the member becomes a load transmission path at the time of a frontal collision. The member can be further reduced in weight by causing a bending shape portion or the like which is likely to be bent at the time of a collision to be a thick portion. In addition, when a thick portion is bent, if the thick portion has low strength, it is easy to perform working. Therefore, it is possible to preferably use variable wall thickness steel pipe in each of the embodiments of the present invention.

In a drive shaft, there are cases where splining is performed with respect to variable wall thickness portions at pipe ends. If this part has a large thickness and low strength, it is easy to perform working. Therefore, it is possible to preferably use variable wall thickness steel pipe in each of the embodiments of the present invention.

Essentials of the above-described embodiments will be summarized below.

(1) For example, the method of manufacturing a variable wall thickness steel pipe according to the first embodiment described by using FIGS. 1(*a*) to 2 is a method of manufacturing a variable wall thickness steel pipe 31 with a hollow tubular (hollow cylindrical) raw pipe 1. The method includes locking the raw pipe 1 in a die 11 by thrusting a plug 21 into the raw pipe 1 from one end side (one end portion 1*a*), so as to expand (increase) an outer shape (outer diameter) on the one end side, in a state where a raw pipe is disposed inside the die and movement of the raw pipe 1 in a longitudinal direction is restricted; and performing ironing in which an inner shape (inner diameter) of the raw pipe 1 is expanded while the outer shape (outer diameter) is maintained so that a thin portion 1*e* (31*e*) is formed by further thrusting the plug 21 toward the other end side (other end portion 1*d*) of the raw pipe 1 while the locked state of the raw pipe 1 is maintained, whereas the restriction on the raw pipe 1 is relaxed.

(2) Then, as shown in FIGS. 1(*c*) and 2, in the method of manufacturing a variable wall thickness steel pipe according to (1), in the performing ironing, an unprocessed portion 31*f* may remain on the other end side (other end portion 1*d*) of the raw pipe 1 by stopping thrusting the plug 21 in the middle.

(3) In addition, as shown in FIGS. 1(*c*) and 2, in the method of manufacturing a variable wall thickness steel pipe according to (1) or (2), a thickness reduction rate of the thin portion 1*e* (31*e*) in the performing ironing may be within a range from 10% to 90%.

(4) In addition, as shown in FIG. 1(*c*), in the method of manufacturing a variable wall thickness steel pipe according to any one of (1) to (3), the plug 21 used in the locking and the performing ironing may include a tip end portion (small-diameter tip end portion 21*a*) having an outer shape size (outer diameter size) smaller than an inner shape size (inner diameter size) of the raw pipe 1, a base end portion (large-diameter base end portion 21*b*) having an outer shape size (outer diameter size) larger than the inner shape size (inner diameter size) of the raw pipe 1 and smaller than an outer shape size (outer diameter size) of the raw pipe 1, and a tapered portion 21*c* being provided between the tip end portion (small-diameter tip end portion 21*a*) and the base end portion (large-diameter base end portion 21*b*) to be tapered from the base end portion (large-diameter base end portion 21*b*) toward the tip end portion (small-diameter tip end portion 21*a*).

(5) In addition, for example, as in the third embodiment described by using FIGS. 7(*a*) to 7(*c*), in the method of manufacturing a variable wall thickness steel pipe according to any one of (1) to (3), the plug 71 used in the locking and the performing ironing may include a base end portion 71*b* having an outer shape size (outer diameter size) larger than an inner shape size (inner diameter size) of the raw pipe 1 and smaller than an outer shape size (outer diameter size) of the raw pipe 1, and a tip end portion (tapered tip end portion 71*c*) leading to a tip end side of the base end portion 71*b* and being tapered as being separated from the base end portion 71*b*.

(6) In addition, for example, as in the seventh embodiment described by using FIGS. 16(*a*) to 16(*c*), in the method of manufacturing a variable wall thickness steel pipe according to (4) or (5), the base end portion may have a large-sized base end portion (large-diameter portion 161*c*) being disposed on the tip end portion side, and a small-sized base end portion (small-diameter base end portion 161*e*) having an outer shape size (outer diameter size) smaller than an outer shape size of the large-sized base end portion.

(7) For example, the method of manufacturing a variable wall thickness steel pipe according to the second embodiment described by using FIGS. 4(*a*) to 6 is a method of manufacturing a variable wall thickness steel pipe 61 with a hollow tubular (hollow cylindrical) raw pipe 1. The method includes locking the raw pipe 1 in a die 11 by thrusting a first plug (plug 21) into the raw pipe 1 from one end side (one end portion 1*a*), so as to expand (increase) an outer shape size (outer diameter size) on the one end side (one end portion 1*a*), in a state where a raw pipe is disposed inside the die and movement of the raw pipe 1 in a longitudinal direction is restricted; pulling the first plug (plug 21) from the raw pipe 1; and performing ironing in which an inner shape (inner diameter) of the raw pipe 1 is expanded while an outer shape (outer diameter) of the raw pipe 1 is maintained so that a thin portion 1*e* (61*e*) is formed by thrusting a second plug (plug 51), which has an outer shape different from the outer shape of the first plug (plug 21), from the one end side (one end portion 1*a*) of the raw pipe 1 toward the other end side (other end portion 1*d*) while the locked state of the raw pipe 1 is maintained, whereas the restriction on the raw pipe 1 is relaxed.

(8) Then, as shown in FIGS. 5(*a*) and 5(*b*), in the method of manufacturing a variable wall thickness steel pipe according to (7), the second plug (plug 51) used in the performing ironing may include a small-sized tip end portion (small-diameter tip end portion 51*a*) smaller than an inner shape size (inner diameter size) of the raw pipe 1, an intermediate-sized portion (intermediate-diameter portion 51*b*) having an outer shape size (outer diameter size) larger than the inner shape size (inner diameter size) of the raw pipe 1, a large-sized portion (large-diameter base end portion 51*c*) having an outer shape size (outer diameter size) larger than the outer shape size (outer diameter size) of the intermediate-sized portion (intermediate-diameter portion 51*b*) and smaller than an outer shape size (outer diameter size) of the raw pipe 1, a first tapered portion (first tapered portion 51*d*) being provided between the small-sized tip end portion (small-diameter tip end portion 51*a*) and the intermediate-sized portion (intermediate-diameter portion 51*b*), and a second tapered portion (second tapered portion 51*e*) being provided between the intermediate-sized portion (intermediate-diameter portion 51*b*) and the large-sized portion (large-diameter base end portion 51*c*).

(9) In addition, as in the fourth embodiment described by using FIGS. 8(*a*) and 8(*b*), in the method of manufacturing a variable wall thickness steel pipe according to (7), the second plug (plug 81) used in the performing ironing may include a base end portion 81*b* having an outer shape size (outer diameter size) larger than the inner shape size (inner diameter size) of the raw pipe 1 and smaller than an outer shape size (outer diameter size) of the raw pipe 1, and a third tapered portion (tapered tip end portion 81*c*) being tapered from the base end portion 81*b* toward a tip end portion 81*a*.

(10) As in the first embodiment described by using FIGS. 1(*a*) to 1(*c*), in the method of manufacturing a variable wall thickness steel pipe according to any one of (1) to (9), the die 11 may include a hollow small-sized portion (hollow small-diameter portion 11*a*) having an inner shape size (inner diameter size) corresponding to the outer shape size (outer diameter size) of the raw pipe 1, a hollow large-sized portion (hollow large-diameter portion 11*b*) having an inner shape size (inner diameter size) larger than the outer shape size (outer diameter size) of the raw pipe 1, and a hollow tapered portion (tapered portion 11*c*) being provided between the hollow small-sized portion (hollow small-diameter portion 11*a*) and the hollow large-sized portion (hollow large-diameter portion 11*b*) and being tapered from the hollow large-sized portion (hollow large-diameter portion 11*b*) toward the hollow small-sized portion (hollow small-diameter portion 11*a*).

(11) As in the sixth embodiment described by using FIGS. 13(*a*) to 13(*c*), in the method of manufacturing a variable wall thickness steel pipe according to (10), the die 13 may further include a hollow intermediate-diameter portion (thickly-formed portion 13*e*) being provided in a part of a hollow small-sized portion (hollow small-diameter portion 13*a*) in the longitudinal direction and having an inner shape size (inner diameter size) larger than the outer shape size (outer diameter size) of the raw pipe 1.

(12) As in the eighth embodiment described by using FIGS. 17(*a*) to 18, the method of manufacturing a variable wall thickness steel pipe according to any one of (1) to (11) may further include drawing the raw pipe 1 (intermediate product 15) after performing ironing.

(13) For example, the method of manufacturing a variable wall thickness steel pipe according to the fifth embodiment described by using FIGS. 10(*a*) to 11 is a method of manufacturing a variable wall thickness steel pipe 111 with a hollow tubular (hollow cylindrical) raw pipe 1. The method includes locking the raw pipe 1 in a die 12 by simultaneously or alternately thrusting plugs 21 and 22 into the raw pipe 1 respectively from one end side (one end portion 1*a*) and the other end side (other end portion 1*d*) of the raw pipe 1, so as to expand an outer shape (outer diameter) on the one end side (one end portion 1*a*) and an outer shape (outer diameter) on the other end side (other end portion 1*d*); pulling the plug 22 on the other end side (other end portion 1*d*) while the plug 21 is inserted on the one end side (one end portion 1*a*); performing first ironing in which an inner shape (inner diameter) of the raw pipe 1 is expanded while the outer shape (outer diameter) is maintained so that a first thin portion (middle portion 1*g*) is formed by further thrusting the plug 21, which is inserted on the one end side (one end portion 1*a*), toward the other end side (other end portion 1*d*) of the raw pipe 1 while the one end side (lock portion 1*g*1 on the one end portion 1*a* side) is locked in the die 12; inserting and pulling the plugs such that the plug 22 is inserted on the other end side (other end portion 1*d*), whereas the plug 21 on the one end side (one end portion 1*a*) is pulled out; and performing second ironing in which the inner shape (inner diameter) of the raw pipe 1 is expanded while the outer shape (outer diameter) is maintained so that a second thin portion (middle portion 1*h*) is formed by further thrusting the plug 22 on the other end side (other end portion 1*d*) toward the one end side (one end portion 1*a*) of the raw pipe 1 while the other end side (lock portion 1*h*1 on the other end portion 1*d* side) is locked in the die 12. In the locking, the raw pipe 1 freely moves in a longitudinal direction of the raw pipe 1 in a case where the plugs 21 and 22 are simultaneously thrust, and movement of the raw pipe 1 in a thrusting direction of the plugs 21 and 22 is restricted in a case where the plugs 21 and 22 are alternately thrust.

(14) According to the fifth embodiment shown in FIG. 11, the method of manufacturing a variable wall thickness steel pipe according to (13) may further include drawing the raw pipe 1 (variable wall thickness steel pipe 111) after performing second ironing.

(15) According to each of the embodiments, in the method of manufacturing a variable wall thickness steel pipe according to any one of (1) to (14), the raw pipe 1 may be a seamless steel pipe.

(16) For example, according to the first embodiment described by using FIG. 2, there is provided a variable wall thickness steel pipe 31 which employs the following configuration including an expanded portion (diameter-increasing portion 31*c*) that is provided on one side in a longitudinal direction and has a largest outer shape size (outer diameter size) in a case of being seen in a cross section perpendicular to the longitudinal direction, and a thin portion (middle portion 31*e*) that is provided on the other side of the expanded portion (diameter-increasing portion 31*c*) in a case of being seen in the longitudinal direction and has a thickness smaller than the thickness of the expanded portion (diameter-increasing portion 31*c*). In a case where an average value of hardness of the expanded portion (diameter-increasing portion 31*c*) is H1 and an average value of hardness of the thin portion (middle portion 31*e*) is H2, H2>H1 is satisfied.

(17) The variable wall thickness steel pipe 31 according to (16) may employ the following configuration further including a thick portion (unprocessed portion 31*f*) that is disposed on the other side of the thin portion (middle portion 31*e*) in a case of being seen in the longitudinal direction and has a thickness greater than the thickness of the thin portion (middle portion 31*e*). In a case where an average value of hardness of the thick portion (unprocessed portion 31*f*) is H3, H2>H1≥H3 may be satisfied.

(18) For example, the variable wall thickness steel pipe 31 according to (17) may employ the following configuration in which the thin portion (middle portion 31*e*) includes a straight pipe portion 31*e*2 having a smallest thickness in the thin portion (middle portion 31*e*), a first tapered portion (lock portion 31*e*1) being provided between the straight pipe portion 31*e*2 and the expanded portion (diameter-increasing portion 31*c*) and having an outer shape (outer diameter) expanded toward the expanded portion (diameter-increasing portion 31*c*), and a second tapered portion (tapered portion 31*e*3) being provided between the straight pipe portion 31*e*2 and the thick portion (unprocessed portion 31*f*) and having a thickness increasing toward the thick portion (unprocessed portion 31*f*). In a case where an average value of hardness of the first tapered portion (lock portion 31*e*1) is H4, an average value of hardness of the straight pipe portion 31*e*2 is H5, and an average value of hardness of the second tapered portion (tapered portion 31*e*3) is H6, both expressions H5>H6≥H3 and H5>H4>H1 may be satisfied.

(19) According to the sixth embodiment described by using FIG. 14, in the variable wall thickness steel pipe 141 according to any one of (16) to (18), the thickness of the thin portion (middle portion 141*e*) may be partially increased (thick portion 141*f*) in a case of being seen in the longitudinal direction.

(20) According to the fifth embodiment described by using FIG. 11, in the variable wall thickness steel pipe 111 according to (16), combinations of the expanded portions (diameter-increasing portions 111*c* and 111*f*) and the thin portions (middle portions 111*g* and 111*h*) may be symmetrically provided at both ends in the longitudinal direction.

(21) The variable wall thickness steel pipe 111 according to (20) may employ the following configuration further including a thick portion (unprocessed portion 111*i*) that is disposed between a pair of the thin portions (middle portions 111*g* and 111*h*) and has a thickness greater than the thickness of the thin portion (middle portions 111*g* and 111*h*). In a case where an average value of hardness of the thick portion (unprocessed portion 111*i*) is H7, H2>H1≥H7 may be satisfied.

(22) For example, according to the eighth embodiment described by using FIG. 18, there is provided a variable wall thickness steel pipe 181 which employs the following configuration including a thick portion (diameter-reducing portion 181*c*) that is provided on one side in a longitudinal direction and has a greatest thickness in a case of being seen in a cross section perpendicular to the longitudinal direction, and a thin portion (middle portion 181*e*) that is provided on the other side of the thick portion (diameter-reducing portion 181*c*) and has a thickness smaller than the thickness of the thick portion (diameter-reducing portion 181*c*). An outer shape size in the longitudinal direction (outer diameter size) is constant. In a case where an average value of hardness of the thick portion (diameter-reducing portion 181*c*) is H8 and an average value of hardness of the thin portion (middle portion 181*e*) is H9, H9>H8 is satisfied.

(23) According to the ninth embodiment described by using FIG. 20(*a*), in the variable wall thickness steel pipe 20 according to any one of (16) to (22), in a case where the thin portion is seen in a circumferential direction of the thin portion in a cross section perpendicular to the longitudinal direction, the thin portion may have a rotationally symmetric shape in which regions (processed portion 20*b*) having a relatively small thickness and relatively high hardness and regions (unprocessed portion 20*a*) having a relatively great thickness and relatively low hardness alternate with each other in the circumferential direction.

(24) In the variable wall thickness steel pipe according to any one of (16) to (23), a seamless steel pipe may be used as a material.

INDUSTRIAL APPLICABILITY

According to the present invention, it is possible to provide a method of manufacturing a variable wall thickness steel pipe, in which a working amount at the time of manufacturing is small and heat treatment such as annealing becomes unnecessary when post-working such as bending is performed, and a variable wall thickness steel pipe.

BRIEF DESCRIPTION OF THE REFERENCE SYMBOLS

1 raw pipe
1*a* one end portion (one end side)
1*d* the other end portion (other end side)
1*e*, 31*e*, 61*e* thin portion
1*g* middle portion (first thin portion)
1*g*1 lock portion on one end portion side (one end side)
1*h* middle portion (second thin portion)
1*h*1 lock portion on the other end portion side (other end side)
11, 12, 13 die
11*a* hollow small-diameter portion (hollow small-sized portion)
11*b* hollow large-diameter portion (hollow large-sized portion)
11*c* tapered portion (hollow tapered portion)
13*a* hollow small-diameter portion (hollow small-sized portion)
13*e* thickly-formed portion (hollow intermediate-diameter portion)
20*a* unprocessed portion (region having large thickness and low hardness)
20*b* processed portion (region having small thickness and high hardness)
21 plug (first plug)
21*a* small-diameter tip end portion (tip end portion)
21*b* large-diameter base end portion (base end portion)
21*c* tapered portion
22, 71 plug
31, 61, 111, 141, 181 variable wall thickness steel pipe
31*c*, 41*c*, 61*c*, 91*c*, 111*c*, 111*f*, 121*c*, 141*c*, 151*c* diameter-increasing portion (expanded portion)
31*e*, 111*g*, 111*h* middle portion (thin portion)
31*e*1 lock portion (first tapered portion)
31*e*2 straight pipe portion
31*e*3 tapered portion (second tapered portion)

31*f*, 111*i* unprocessed portion (unprocessed portion, thick portion)

51, 81 plug (second plug)

51*a* small-diameter tip end portion (small-sized tip end portion)

51*b* intermediate-diameter portion (intermediate-sized portion)

51*c* large-diameter base end portion (large-sized portion)

51*d* first tapered portion (first tapered portion)

71*b*, 81*b* base end portion

71*c* tapered tip end portion (tip end portion)

81*a* tip end portion

81*c* tapered tip end portion (third tapered portion)

141*e* middle portion (thin portion)

161*c* large-diameter portion (large-sized base end portion)

161*e* small-diameter base end portion (small-sized base end portion)

181*c* diameter-reducing portion (thick portion)

181*e* middle portion (thin portion)

The invention claimed is:

1. A method of manufacturing a variable wall thickness steel pipe with a hollow tubular raw pipe, the method comprising:

locking the raw pipe in a die by thrusting a plug into the raw pipe from an one end side, so as to expand an outer shape on the one end side, in a state where the raw pipe is disposed inside the die and movement of the raw pipe in a longitudinal direction is restricted; and performing ironing in which an inner shape of the raw pipe is expanded while the outer shape is maintained so that a thin portion is formed by further thrusting the plug toward the other end side of the raw pipe while the locked state of the raw pipe is maintained, whereas the movement of a portion of the other end side of the raw pipe is unrestricted so that the portion of the other end side of the raw pipe is elongated in the longitudinal direction, thereby obtaining the variable wall thickness steel pipe.

2. The method of manufacturing a variable wall thickness steel pipe according to claim 1, wherein in the performing ironing, an unprocessed portion remains on the other end side of the raw pipe by stopping thrusting the plug in the middle.

3. The method of manufacturing a variable wall thickness steel pipe according to claim 2, wherein a thickness reduction rate of the thin portion in the performing ironing is within a range from 10% to 90%.

4. The method of manufacturing a variable wall thickness steel pipe according to claim 2, wherein the plug used in the locking and the performing ironing includes, a tip end portion having an outer shape size smaller than an inner shape size of the raw pipe, a base end portion having an outer shape size larger than the inner shape size of the raw pipe and smaller than an outer shape size of the raw pipe, and a tapered portion being provided between the tip end portion and the base end portion so as to be tapered from the base end portion toward the tip end portion.

5. The method of manufacturing a variable wall thickness steel pipe according to claim 1, wherein a thickness reduction rate of the thin portion in the performing ironing is within a range from 10% to 90%.

6. The method of manufacturing a variable wall thickness steel pipe according to claim 5, wherein the plug used in the locking and the performing ironing includes, a tip end portion having an outer shape size smaller than an inner shape size of the raw pipe, a base end portion having an outer shape size larger than the inner shape size of the raw pipe and smaller than an outer shape size of the raw pipe, and a tapered portion being provided between the tip end portion and the base end portion so as to be tapered from the base end portion toward the tip end portion.

7. The method of manufacturing a variable wall thickness steel pipe according to claim 1, wherein the plug used in the locking and the performing ironing includes, a tip end portion having an outer shape size smaller than an inner shape size of the raw pipe, a base end portion having an outer shape size larger than the inner shape size of the raw pipe and smaller than an outer shape size of the raw pipe, and a tapered portion being provided between the tip end portion and the base end portion so as to be tapered from the base end portion toward the tip end portion.

8. The method of manufacturing a variable wall thickness steel pipe according to claim 7, wherein the base end portion has a large-sized base end portion being disposed on the tip end portion side, and a small-sized base end portion having an outer shape size smaller than an outer shape size of the large-sized base end portion.

9. The method of manufacturing a variable wall thickness steel pipe according to claim 1, wherein the die includes, a hollow small-sized portion having an inner shape size corresponding to the outer shape size of the raw pipe, a hollow large-sized portion having an inner shape size larger than the outer shape size of the raw pipe, and a hollow tapered portion being provided between the hollow small-sized portion and the hollow large-sized portion and being tapered from the hollow large-sized portion toward the hollow small-sized portion.

10. The method of manufacturing a variable wall thickness steel pipe according to claim 9, wherein the die further includes a hollow intermediate-diameter portion being provided in a part of the hollow small-sized portion in the longitudinal direction and having an inner shape size larger than the outer shape size of the raw pipe.

11. The method of manufacturing a variable wall thickness steel pipe according to claim 1, further comprising:

drawing the variable wall thickness steel pipe after performing ironing.

12. The method of manufacturing a variable wall thickness steel pipe according to claim 1, wherein the raw pipe is a seamless steel pipe.

* * * * *